United States Patent [19]

Sivachenko et al.

[11] Patent Number: 4,899,941

[45] Date of Patent: Feb. 13, 1990

[54] APPARATUS FOR GRINDING

[76] Inventors: Leonid A. Sivachenko, Pereulok, I.Franko, 7, kv. 1; Alexandr M. Kurguzikov, Slavgorodskoe shosse, 21, both of Mogilev; Vladimir V. Moiseenko, Mogilevsky raion, stantsia Buinichi, 10, kv. 26, Mogilevskaya oblast; Sergei L. Bochkov, ulitsa Artjukhinoi, 6/10, kv. 69, Moscow; Evgeny G. Golban, ulitsa Kosmanavtov, 20, kv. 46; Maria V. Lescheva, Slavgorodskoe shosse, 127, both of Mogilev, all of U.S.S.R.

[21] Appl. No.: 271,954

[22] PCT Filed: Jan. 27, 1987

[86] PCT No.: PCT/SU87/00009

§ 371 Date: Sep. 29, 1988

§ 102(e) Date: Sep. 29, 1988

[87] PCT Pub. No.: WO88/05343

PCT Pub. Date: Jul. 28, 1988

[51] Int. Cl.[4] ..... B02C 19/22

[52] U.S. Cl. ..... 241/134; 241/152 R; 241/260.1

[58] Field of Search ..... 241/152 R, 134, 141, 241/161, 162, 260.1

[56] References Cited

U.S. PATENT DOCUMENTS 3,797,763 6/1974 Handle ..... 241/82.1

FOREIGN PATENT DOCUMENTS 919889 4/1982 U.S.S.R. .

2054406 2/1981 United Kingdom .

OTHER PUBLICATIONS

Equipment for Plants of Paint and Varnish Industry by Gorlovsky et al., Kozulin N.A. Publishing House "Khimya", 1980 Leningrad, pp. 158–161.

Mechanical Equipment of Enterprises Producing Building Materials, Articles and Constructions by Bauman V. A. et al., Publishing House "Mashinostroenie", Moscow, 1981, pp. 130–132.

*Primary Examiner*—Timothy V. Fley

*Attorney, Agent, or Firm*—Lilling & Greenspan

[57] ABSTRACT

In an apparatus for grinding comprising at least one grinding working member (1) kinematically associated with a drive (6), according to the invention, the working member (1) is made in the form of at least one arc-shaped spiral (2) with a progressive winding, associated with the drive (6) for rotation about its center line (13), the adjacent coils of the working member (1) being contiguous with one another on the inside radius of curvature of the working member (1).

63 Claims, 39 Drawing Sheets

APPARATUS FOR GRINDING

BACKGROUND OF THE INVENTION

1. Field of the Invention

The present invention relates to equipment used for mechanical treatment of disperse materials and more particularly to grinding aimed at obtaining finely dispersed powders, suspensions, emulsions and pastes.

2. Description of the Prior Art

At present disintigration of hard materials is accomplished by means of most widely used ball mills comprising a revolving drum partially filled with freely moving grinding media such as spherical bodies (balls) or of other shapes, and a material subject to grinding (cf. Equipment for Plants of Paint and Varnish Industry by Gorlovsky N. A., Kozulin N. A., Publishing House "Khimya", 1980, Leningrad, p.p. 158–161).

At the present time the potential of ball mills have mainly been exhausted. This is explained by the fact that power intensity of the grinding process cannot be substantially increased. Moreover, the grinding media act on a raw product stochastically which manifests itself in a substantial number of idle impacts of the grinding bodies with one another and with walls of the drum. Therefore the ball mills are very cumbersome, operate with a substantial noise, consume a great amount of power and provide a low specific output.

Further improvement of the mills is associated with increase in the power intensity of the grinding process and with the improvement of the crushing mechanism. As a practical embodiment of the above-mentioned trends in improvement of the mills, there is presented a vibratory grinding of the effectiveness of which amounts to increase in the number of impacts of the grinding bodies with one another and with walls of a grinding chamber (cf. Mechanical Equipment of Enterprises Producing Building Materials, Articles and Constructions by Bauman V. A. et al, Publishing House "Mashinostroenie", Moscow, 1981, p.p. 130–132). However, the vibratory mills are complex in design, operate with a substantial noise, transmit vibrations to the environment, have supporting bearings with a short service life, fail to be fed with lumpy material and consume much power. The grinding process of these machines is characterized by the most pronounced cyclic action.

Evolution in the development of the grinding technique has led to production of planetary mills (cf. Equipment for Plants of Paint and Varnish Industry by Gorlovsky N. A., Kozulin N. A., Published House "Khimya", Leningrad, 1980, p.p. 158–161) which are essentially drums moving along planetary trajectories and internally accommodating grinding bodies. Featuring, on the whole, a substantially high intensity of the grinding process, the planetary mills by their technical and economic indices have to specific advantages over the vibratory mills, but are more complex in design.

Widely known in the prior art are impact mills in which the working members are operating at increased speeds and of which may be singled out disintegrators comprising two discs rotating in opposite directions and provided with grinding bodies in the form of bars (cf. Mechanical Equipment of Interprises Producing Building Materials, Articles and Constructions by Bauman V. A. et al, Publishing House "Mashinostroenie", Moscow, 1981, p.p. 128–129). A relative peripheral velocity of the bars is substantially high and amounts to 200–250 m/s of which causes their rapid wear and prevents the desintegrators from being used for treatment of materials having Mohs' hardness over 4 and containing no large hard inclusions.

Well known to the prior art are crushing apparatus, for example, roll mills in which the crushing members are presented by revolving rolls (cf. Equipment for Plants of Paint and Varnish Industry by Gorlovsky N. A., Kozulin N. A., Publishing House "Khimya", Leningrad, 1980, p.p. 319–321). However these mills have a small number of crushing zones, fail to provide fine and extra fine crushing and also due to the fact that the material slips over the surface of the rolls the roll mills are not suitable for crushing abrasive materials.

SUMMARY OF THE INVENTION

The main object of the present invention is to provide an apparatus for grinding with such a grinding member which will provide a plurality of zones for active and continuous grinding of materials, an efficient gripping and delivery of raw material components in the grinding zones, the forces required for grinding, a timely discharge of the ground fraction from the grinding zone, with the apparatus being simple in design.

This object is attained by that in an apparatus for grinding comprising at least one working member kinematically associated with a drive, according to the invention, the working member is made in the form of at least one arc-shaped spiral with a progressive winding associated with the drive for rotation about its center line, the adjacent coils of the working member being contiguous with one another on the inside radius of curvature of the working member at least on one portion of the length thereof.

Such an embodiment allows the working member to grip by its intercoil spaces the material to be ground and to pull it along in a wedge-shaped space between the spiral coils until it is completely ground in a continuous process. As a result, a plurality of active grinding zones are provided into which the material is efficiently delivered under the action of centrifugal and gravitational forces.

According to the invention the central angle of the arc of the working member center line is in a range of 1° to 360° .

Such an embodiment of the working member provides optimum modes of grinding process including the provision of forces required for grinding and variations in the finess of grinding.

The apparatus may be made such that the center line of working member spiral has at least one point of inflection.

This allows the apparatus to be built in the process lines and units at production enterprises when the grinding and conveying operations are combined.

The center line of the working member spiral may also be made in the form of a space curve.

This additionally widens the scope for building in the apparatus in the process lines.

It is expedient that an alternative embodiment of the apparatus by provided with a working member wherein the spiral thereof has the diameter of winding gradually varying from one end of the working member towards the other end.

This makes it possible to change the character of the working member action on the material in accordance with the granulometric composition thereof.

It is also expedient that in an alternative embodiment of the working member the spiral thereof be made with the diameter of winding periodically varying throughout the length of said spiral.

In this case the intensity of grinding is raised due to increase in the number of zones of contacts between the coils of the spiral body adjacent projections.

The coils of the working member may be U-shaped in cross-section.

This makes it possible to intensify the working process and to increase the fineness of material grinding at the expense of increasing the amount of the material being simultaneously ground. In this alternative embodiment the working member actively abrades the material which allows it to be used for treatment of both the loose and viscous materials, and also emulsions and suspensions.

It is advantageous that the working member spiral be made wedge-shaped in cross-section.

This makes it possible to provide a linear contact between the adjacent coils of the grinding member which increases the intensity of dispersion due to the fact that the coils simultaneously grip a large amount of the raw material and feed it into the grinding zones. In addition, the working member may effect by the sharp edges of its coils a cutting action on the material which widens the applicability of the apparatus.

From the practical standpoint, it is advantageous that in an alternative embodiment of the apparatus the grinding member spiral be made of flats having in cross-section two parallel sides the length of which is substantially greater than the distance therebetween.

Such an embodiment of the working member provides a high intensity of the dispersing processes along with a substantial torsional rigidity of the grinding member. The last quality allows the working member to be made of substantial dimensions for action on greater volumes of the material along with the simplicity in the design.

The working member spiral may be wound so that the longitudinal axis of the coil section is inclined to the normal to the center line of the spiral.

This improves the delivery of material in the grinding zones between the coils at the expense of undercutting the mass of the material adjacent to the working member. This is of particular importance when viscous materials and materials tending to aggregation are subjected to grinding.

The spiral may be made of flats with at least one bent edge.

Due to this the material moves more rapidly in the zones of dispersion between the coils. Besides, the amount of material delivered in the grinding zones is increased due to the fact that said material is carried along by the bent edges which contributes to self-grinding of the material retained in the intercoil spaces.

It is desirable that in a working member the spiral be made of flats with at least one of the edges thereof being pointed.

Such a solution makes it possible to break the material by the cutting action and also to improve its delivery in the zones of crushing in the intercoil spaces.

It is preferred that at least one of the surfaces of the spiral coils be provided with alternating projections and interprojection spaces.

This increases the number of grinding zones and the specific pressure at the points of contact, and also insures the impact grinding and cutting of materials.

In many cases it is required that the grinding member spiral be made multiple-stranded.

This simplifies the technological procedure of manufacturing the spiral, as it can be made of an existing material, for example, a wire rope the elements of which have moderate cross-sections but are distinguished for their strength.

The side surfaces of the working member spiral coils may be provided with plates of a wear-resistant material in the form of circular segments.

In grinding of abrasive and strong materials, this substantially extends the durability of the working member and contributes to decrease in contamination of the ground product.

It is expedient to make the grinding member spiral sectional comprising at least two sections.

In this case blanks of smaller length are required for manufacture of the sections and the manufacture proper is simplified. The working member in this case may have large dimensions.

In addition, it is preferred that the sections should have different diameters of the spiral winding, as each of the sections effects that stage of grinding which corresponds to the optimum conditions of the grinding process with due regard to physico-mechanical properties of the material being ground.

It is likewise preferred that the section be interconnected for rotation relative to each other.

This makes it possible to transmit the torque to both ends of the working member without bringing their rotational speeds in synchronism. This increases the intensity of the process and insures the grinding and dispersion of strong and viscous materials.

An additional spiral may be wound over the external surface of the spiral coil body.

This increases the number of zones of contacts and the specific pressures therein which substantially steps up the intensity of the apparatus operation.

It is advantageous to make the working member of at least two spirals installed one inside the other.

Due to this the number of grinding zones is increased which steps up the intensity of grinding at a high torsional rigidity of the working member.

It is also advantageous to make the spirals of different diameters, in which case the ends of the spirals are set concentric with and central portions are set eccentric to their center lines, and their coils come in contact at least in one like zone of the maximum deformation to the modulus of elastisity.

Such an embodiment of the working member additionally provides a great number of zones wherein the material is subjected to dispersion which increases the output and the fineness of grinding.

In a number of cases, it is preferred to make the spirals to be installed one inside the other of flats and to provide them with windings wherein the longitudinal axis of section of the body of coils of one spiral is perpendicular to the longitudinal axis of section of body of coils of the other spiral.

Such a design embodiment increases the intensity and fineness of grinding by way of retaining the material between the spiral coils and extending the time of its keeping in the grinding zone.

The fact that the spirals are installed coaxially one inside the other ensures their uniform charging with a raw material and improves the operating conditions.

The spirals may be made of an equal diameter and installed one inside the other.

This simplifies the manufacture of the working member which comprises like elements.

The spirals may also be made of an equal diameter, installed one inside the other and may have a different pitch of winding.

In this case the specific pressures at the points of contact are increased which may reduce the curvature of the working member center line, as the force bringing the coils in contact with one another has been obtained before bending. This extends the durability of the working member, as lesser alternate stresses are set up in the coils thereof.

From the standpoint of widening the grinding potential of the apparatus, it is preferable to make a working member in which the spirals of equal diameter should bear against each other in the zone of the inside radius of curvature of the working member in pairs by lateral surfaces of opposite sides of the adjacent coils of the spirals at one side, while at the other side there should be clearance between the lateral surfaces of the opposite sides of the spiral coils, said clearance being larger than the clearance between the coils of the spirals in the zone of the outside radius of curvature of the working member.

Such an embodiment of the working member allows the final product to be obtained of two granulometric compositions having two different size ranges of particles.

The grinding potentialities of the apparatus may be varied by making the spirals with different profiles of the body of coils insuing the point contact thereof.

This ensures a required force of squeezing the material under treatment and improves the conditions of delivery of the material in the grinding zones by way varying the profile of adjacent coils which intensifies the operation of the grinding apparatus.

It is most advantageous to make the working member of spirals having U-shaped sections, the edges of adjacent coils thereof being directed towards each other and inserted one inside the other.

Due to this the adjacent coils of the spirals come in contact with one another both on the inside and outside radii of curvature of the working member which makes it possible to obtain a great number of dispersion zones and to step up the intensity of the apparatus operation.

For treating a plurality of products, it is desirable that in one of the spirals the coil body be rectangular in cross-section and in the other one the coil body be double-T in cross-section, the coils of the spirals being alternated, while the longitudinal axis of symmetry of the coil rectangular in cross-section and the axis of symmetry of the coils double-T in cross-section are normal to the center line of the working member.

A high fineness of grinding on the open cycle in a continuous mode is defined by the fact that the material cannot pass through the working member unless it has reached a predetermined fineness ratio.

Abrasive and hard products may advantageously be ground by way of making side surfaces of the body of adjacent coils of the spirals profiled at least along quadratic curves insuring the mutual rolling of said coils.

Due to this the mutual slip of the adjacent coils ia brought to a minimum, as a result of which the durability of the working member is extended.

For grinding extra strong and hard materials, it is preferred to make one of the spirals of flats provided with openings internally accommodating bodies of revolution. This substantially increases the specific pressures at the points of contact which improves the quality of the ground product and its activation in particular.

It is advantageous that the working member be provided with a means for intensifying the grinding process made, for example, in the form of at least one cone-shaped roll installed at the end of the working member in its space and facing the latter by the vertex of the cone, the roll generatrix being snugly contiguous with the coils of the spiral in the zone of the larger radius of curvature of the working member.

Reduction of this alternative embodiment to practice makes it possible to crush the material lumps the size of which exceeds the maximum clearance between the adjacent coils of the working member.

It is likewise desirable to apply to the working member an extraneous force directed along the radius towards the center of curvature of the center line of said working member.

This makes it possible to raise the specific pressures in the zones where the coils come in contact which increases the power intensity of the apparatus.

An extraneous force may be developed by means of at least one roller which is installed inside a central portion of the working member and has its end faces associated with the ends of the working member through the medium of flexible elements.

This is achieved without any substantial complication of the construction and ensures rapid and qualitative grinding of the material.

An important means in development of an extraneous force directed along the radius towards the center of curvature of the working member center line resides in the development of this force through the medium of a magnetic field.

Embodiment of this method allows a smooth and contactless regulation of the force pressing the coils to one another in compliance with strength characteristics of the material being ground.

It is also advantageous to apply to at least one of the ends of the working member an extraneous force directed tangent to the center line thereof, the central angle of said working member arc being essentially in a range of 1° to 135° .

An increase of the specific forces at the points of contact is in this case ensured along with an obvious simplicity of the construction.

According to the invention, the working member is installed of a frame, one end of said working member being secured for movement relatively to the other end.

This allows the curvature of the working member center line to be varied and hence to change the character of action on the material being ground in compliance with the properties thereof.

The apparatus may conveniently be made such that one end of the working member is secured on the shaft of a drive, for example, an electric drill, and the other end is installed on the axle of an additional support rigidly associated with a housing of the drive.

This makes it possible to grind small portions of materials in open vessels more rapidly and right before the use.

The apparatus for grinding may preferably comprise a chamber for treatment of a material, made in the form of a tube encompassing the working member and the axis of which coincides with the center line of the working member.

Such an embodiment provides a rapid and qualitative grinding of the material, as the grinding chamber contains a comparatively small amount of the material which while passing along the center line of the tube is subjected to treatment.

To provide a fine grinding, it is expedient that the ends of the chamber are interconnected by a pipeline.

This ensures a continuous circulation of the material through the grinding chamber until a required fineness of dispersity is achieved.

It is likewise advantageous that the grinding chamber be installed on a frame for turning about a substantially horizontal axis in the plane of the working member center line.

This turn ensures an optimum loading of the grinding chamber and elimination of stagnant zones wherein the material is not subjected to action of the working member.

The grinding chamber may suitably be made of an elastic material.

This simplifies the construction and facilitates replacement of the working member.

The grinding chamber may advantageously be provided with a deflecting means fixedly secured on the internal surface thereof.

This ensures the delivery of material in the intercoil spaces which allows the grinding time to be cut down.

It is also advantageous to make the deflecting means in the form of a helical spiral.

Such a solution increases the intensity of grinding due to deflection of the material flows and their direction in the dispersion zones. All this on the whole contributes to a more rapid production of the material of a required quality.

In addition, a portion of the chamber wall disposed in the zone of the outside radius of curvature of the working member may be made of an elastic material and kinematically associated with a source of oscillations directed normal to the center line of the working member.

In this case the material to be ground is positively delivered in the grinding zones which intensifies the grinding process.

In an alternative embodiment, the apparatus may suitably be provided with a centrifugal pump the impeller of which is installed at one of the ends of the working member and a pump housing is disposed at the outlet of the grinding chamber.

With such embodiment of the apparatus, a liquid material enters the chamber and is drawn inside the working member by the pump, then it passes between the spiral coils and is appropriately ground. The material cannot pass past the working member.

In many cases, it is preferred that the apparatus be provided with a cone-shaped vessel disposed vertically with its vertex facing down and internally accommodating a pipe which is arranged substantially coaxial with said vessel, a lower end of said pipe is communicated with a discharge connection of the centrifugal pump and an upper end enters the vessel, the lower portion of the vessel being communicated with the inlet of the grinding chamber.

Such a construction ensures a continuous circulation of the material until a required degree of dispersity is obtained.

From the practical standpoint, it is advantageous to make the apparatus with a separating chamber in the form of two cones associated by the bases thereof and with vertices directed oppositely along the vertical axis, provided with connections for delivery of a material to be ground and for discharge of the ground fraction, and with an arrangement for delivery of compressed air in the lower cone, the inlet of the grinding chamber being communicated with the lower end of the separating chamber and the outlet thereof being disposed in a central portion of the base surface.

Introduction of the separating chamber in the apparatus ensures a timely removal of the ground fraction from the apparatus which reduces the power intensity and steps up the output of the machine.

It is preferred to use a plurality of working members each of which should be disposed in a tubular chamber and the chambers should be communicated with one another in succession.

This ensures operation of the apparatus in a continuous mode on the open cycle which permits obtaining the product of a required grinding fineness as the product is under treatment during a substantial period of time. In this case the conveying of the material is also ensured and the apparatus is readily built in the acting process lines.

In an alternative embodiment the apparatus may comprise a plurality of working members installed in a grinding chamber made in the form of a tray and separated from one another by partitions passing normal to the chamber center line and each of said partitions forms together with an opposite wall a port occupying not more than half of the chamber cross-section and directly bears against one of the walls, the ports of adjacent partitions being disposed in a staggered order.

The presence of the partitions with the ports extends the path of flows of the material being ground and prolongs the time of keeping the material in the grinding zones.

In an alternative embodiment, the apparatus with a plurality of working members comprises a grinding chamber made in the form of a tray with a cover having a connection for removal of the ground fraction and internally accommodates partitions which separate the working members and are installed with a clearance in relation to the internal surface of the chamber, means for delivery of air being disposed between the adjacent working members.

With such an embodiment the ground fraction is timely removed from the apparatus and the presence of the partitions installed with a clearance in relation to the internal surface of the chamber contributes to a more efficient movement of the particles in the grinding zones. This apparatus has also a high output.

In a further embodiment, the apparatus with a plurality of working members comprises a grinding chamber made in the form of two concentrically disposed trays with the working members arranged therebetween, at least one of the trays being installed on a frame for oscillation in the direction of the chamber center line.

All this makes it possible to pass substantial amounts of material through the working members. Oscillations of the tray, primarily of the external one, improve the conditions for getting of particles in the intercoil spaces and eliminate sticking of the material to the surface of the trays.

The apparatus may also be made with a plurality of working members disposed in a grinding chamber in the form of a tray made up of two sections interconnected by their end faces in which the center lines form in a vertical plane an obtuse angle with its vertex facing down, a means for delivery of air being installed in the zone of interconnection of the sections, while the chamber is provided with a cover having a connection for removal of the ground fraction.

This results in good ventilation of a central portion of the apparatus due to which all the loaded material under the action of gravitational forces tends to get in this central portion and insures removal of the ground fraction.

A grinding apparatus comprising a plurality of working members may suitably be provided with a grinding chamber formed by face and side walls, wherein the working members arranged one over another, while the arcs of their center lines with the central angles being essentially in a range of 1° to 135° are equidistant and lie in one plane, partitions being secured on each side wall to alternately separate the working members and each of the partitions is installed with a clearance in relation to an opposite side wall.

Such an arrangement of the working members makes it possible to reduce the power intensity of the process, as the material passes through all the grinding zones under the action of gravitational forces. The presence of the partitions prevents the material from passing past the dispersion zones and at the same time substantially increases the apparatus output.

It is desirable that the apparatus be provided with a grinding chamber made in the form of a drum installed for rotation about the horizontal axis, the torque of a drive being applied to the grinding chamber and the ends of the working member being rigidly secured on the end plates of the drum coaxially with the axis of rotation, and a weight is fastened to a central portion of the working member.

All this makes it possible to grind toxic, explosive and poisonous substances in a hermetically sealed drum, with the apparatus being simple in design.

It is likewise preferable to make the apparatus with a working member in the form of a portion of the body formed by rotation of an U-shaped contour about the axis normal to the axis of symmetry of the generatrix and an end wall with a drive installed thereon, the chamber being installed for rotation relative to the end wall about the axis of the body of rotation and the center of curvature is disposed on this axis.

Such an embodiment ensures rapid unloading and cleaning of the chamber, and replacement of the working member.

The apparatus may comprise a grinding chamber of a spherical shape which internally accommodates a working member associated by one end with a drive shaft the axis of which coincides with the vertical axis of the chamber, the other end of the working member being installed for free rotation in a support disposed on a free end of the cantilever installed for rotation about the axis of the drive shaft.

This makes it possible to grind a substantial volume of material by one working member, with the apparatus being simple in design.

The apparatus may advantageously be provided with a cantilever made in the form of a tube encompassing the working member and provided with a port for intake of material disposed at a free end of the tube. In this case the tube has zones wherein the intensity of dispersion is substantially high and all the material is repeatedly subjected to the grinding action which improves its quality.

Design of the grinding apparatus, according to the invention, permits the working process to be substantially intensified, as the working member provides a great number of zones with active and continuous action on the material to be ground, efficient gripping and delivery of the material in the grinding zones and a timely removal of the ground fraction from the grinding chamber. This substantially reduces the power intensity of the process and metal intensity of the construction, with the apparatus being simple in design.

BRIEF DESCRIPTION OF THE DRAWINGS

The invention will now be described in greater detail with reference to specific embodiments thereof, taken in conjunction with the accompanying drawings, wherein.

DESCRIPTION OF THE PREFERRED EMBODIMENTS

Figure 1:
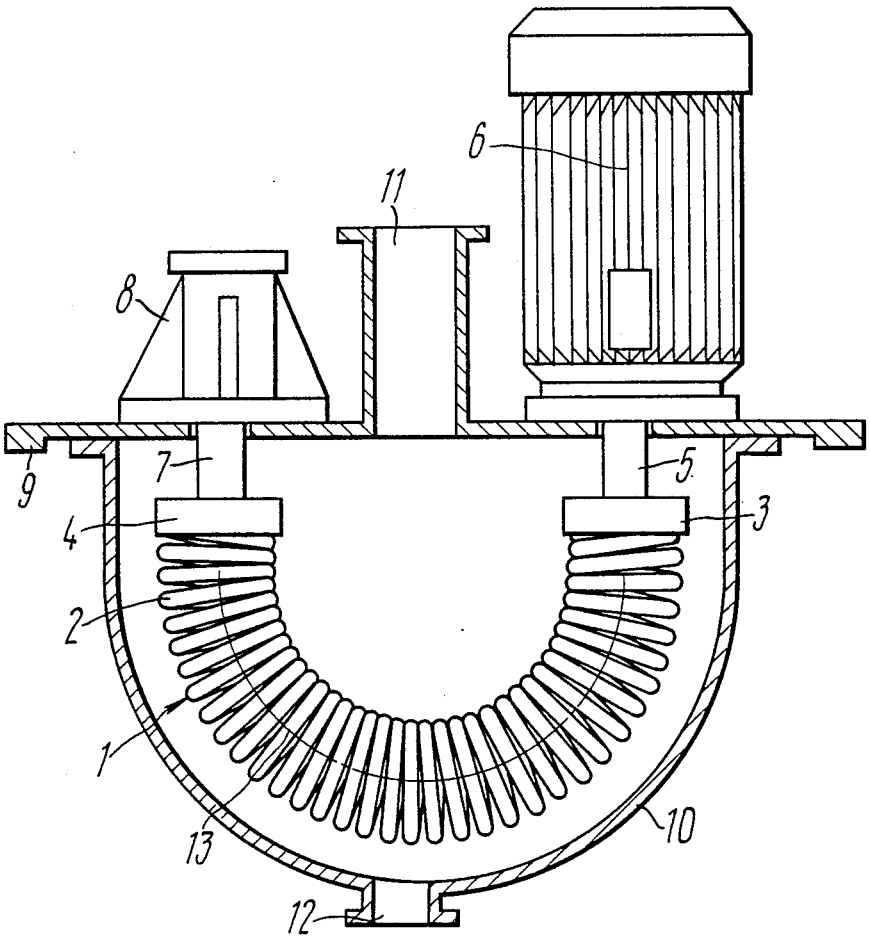
FIG. 1 diagrammatically illustrates an apparatus for grinding with a working member, wherein the adjacent coils bear against one another on the inside radius of curvature throughout the entire length of the working member.

An apparatus for grinding, according to the invention, comprises a working member 1 (FIG. 1) made in the form of an arc-shaped spiral 2 installed by means of attachment units 3,4 on a shaft 5 of a driving electric motor 6 and on a shaft 7 of a support 8. The driving electric motor 6 and the support 8 are installed on a frame 9 which also mounts a grinding chamber 10 internally accommodating the working member 1. A port 11 is provided for loading starting materials and a port 12 is provided for unloading the ground product.

In a described embodiment all coils of the spiral 2 bear against one another along the inside radius of curvature of the working member 1 throughout the entire length thereof.

The apparatus for grinding operates in the following manner.

After the driving electric motor 6 is switched on its starts to rotate the working member 1 relative to its center line 13. The starting material is delivered in the chamber 10 through the loading port 11. In the chamber the material passes in the zone of action of the spiral 2 the coils of which grip and draw it in converging wedge-shaped spaces wherein the material is subjected to a crushing action and is crushed. In this case the spiral 2 due to its progressive winding moves the material along its center line 13. A certain amount of the surplus material accumulates at one of the ends of the working member 1 and under the action of gravitational forces it is once again delivered to the other end of the working member 1 for repeated treatment. All the coils are engaged in the grinding the fineness of which depends on the operating time of the apparatus. The maximum size of lumps which can be ground equals the maximum clearance between the coils of the spiral 2 on the outside radius of curvature of the working member 1. The finished product is unloaded through the port 12.

Figure 2:
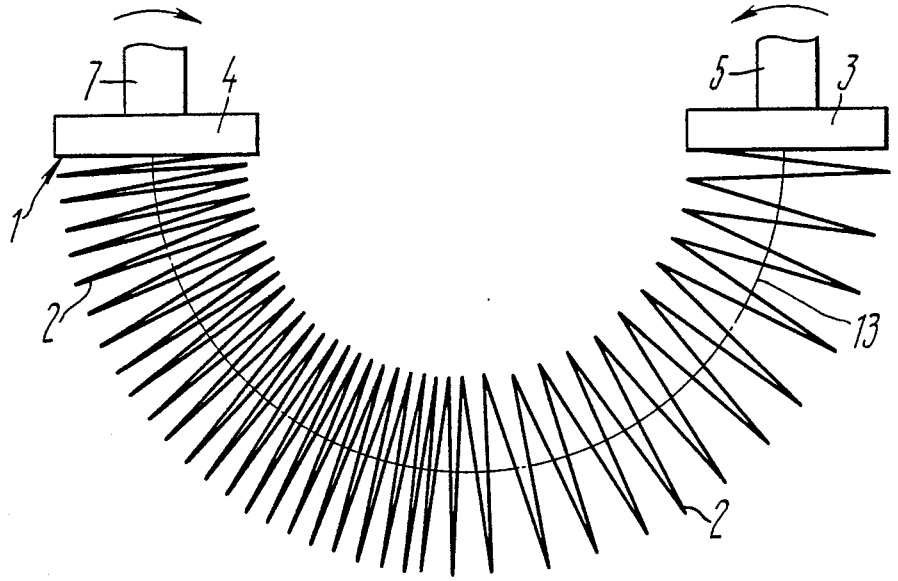
FIG. 2 illustrates a working member, wherein the adjacent coils bear against one another on half of the working member length on the inside radius of curvature.
Figure 3:
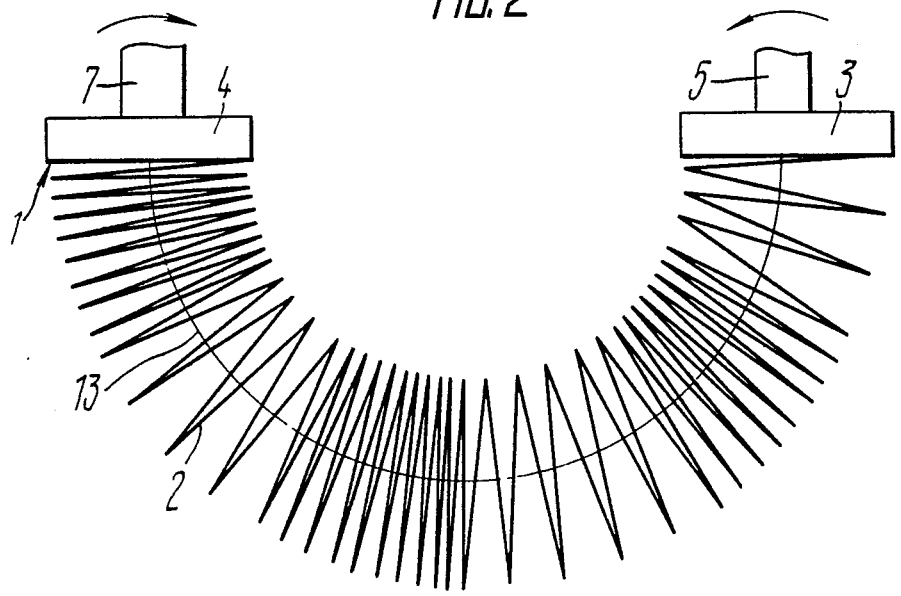
FIG. 3 illustrates a working member, wherein groups of adjacent coils bearing against one another on the inside radius of curvature are alternating with groups which do not bear against one another throughout the length of the working member.
Figure 4:
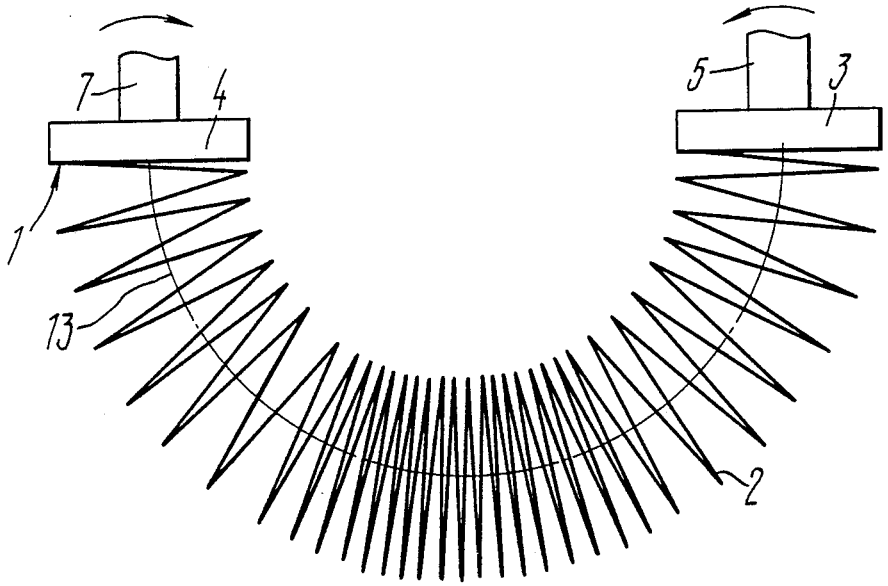
FIG. 4 illustrates a working member, wherein the adjacent coils bear against one another on the inside radius of curvature in its central portion.
Figure 5:
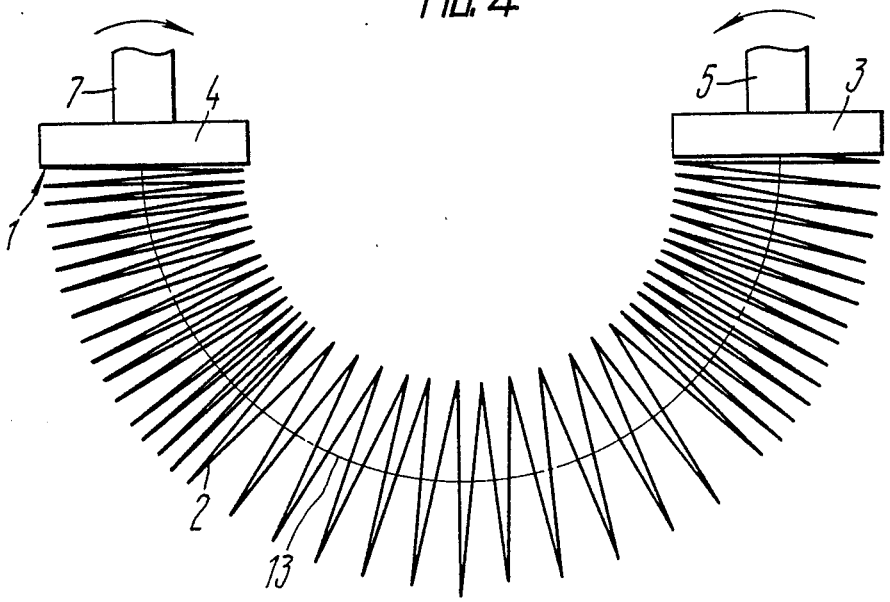
FIG. 5 illustrates a working member, wherein the adjacent coils bear against one another at its ends.

In alternative embodiments of the working member illustrated in FIGS. 2–5, the spiral 2 is made such that its coils bear against one another only on a portion of the length of the working member 1. FIG. 2 illustrates the working member 1 wherein the adjacent coils are in contact on one half of its length, FIG. 3 illustrates the working member 1 wherein groups of the adjacent coils being in contact are alternating with groups of coils which are not in contact throughout its length, FIG. 4 illustrates the working member 1 wherein the adjacent coils are in contact in its central portion, FIG. 5 illustrates the working member 1 wherein the adjacent coils are in contact at its ends. Due to this the working members 1 of FIGS. 2–5 have an increased clearance between the coils which are not in contact with one another which facilitates the delivery of material inside the spiral 2 and increases the intensity of its delivery in the grinding zones. In these cases the grinding process is similar to that taking place in the apparatus wherein all the coils are in contact (FIG. 1).

Figure 6:
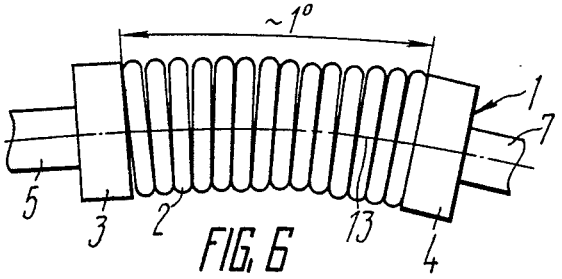
FIG. 6 illustrates a working member, wherein the central angle of the arc of the center line of the working member has a minimum value close to 1°.

An embodiment of the working member (FIG. 6), according to the invention, having a minimum value of the central angle of the arc of its center line 13, close to 1°, insures an effective grinding of a fine fraction. When the spiral 2 installed by means of the attachment supports 3,4 respectively on the shafts 5, 7 is rotating the particles are well retained by the side surfaces of the adjacent coils due to very small angles of gripping, and this substantially improves their dispersion. In this case the durability of the working member 1 is the highest, as the internal stresses developing therein during rotation are at a minimum.

Figure 7:
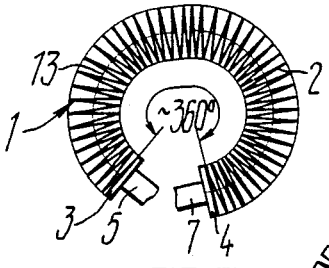
FIG. 7 illustrates a working member, wherein the central angle of the arc of the center line of the working member has a maximum value close to 360°.

The working member 1 (FIG. 7 when made with a maximum value of the central angle of the arc of its center line 13, close to 360°, also comprises the spiral 2 installed by means of the attachment units 3, 4 on the shafts 5, 7 respectively. During operation of this working member the material is ground in succession in all wedge-shaped spaces between the coils and the maximum clearances between the adjacent coils on the outside radius of curvature of the working member 1 may be in this case substantial which makes it possible to grind a coarse-dispersed product.

Figure 8:
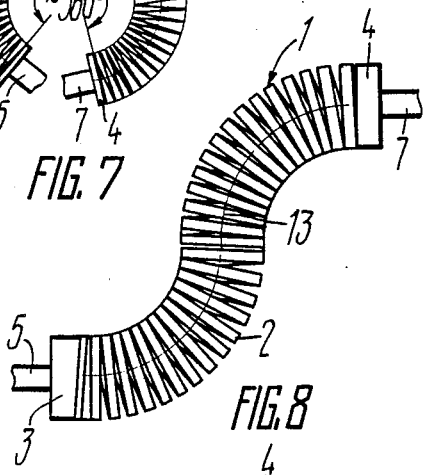
FIG. 8 illustrates a working member, wherein the center line has one point of inflection, while the ends are parallel to each other.
Figure 9:
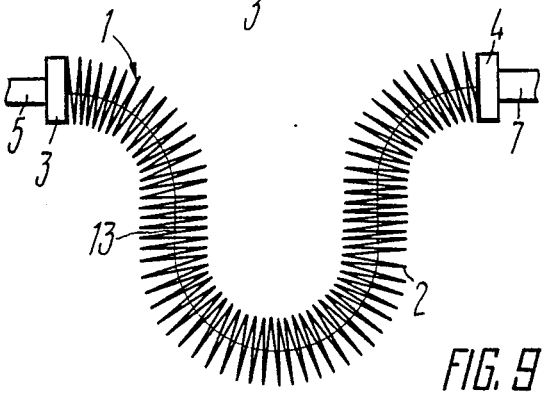
FIG. 9 illustrates a working member, wherein the center line has two points of inflection, while the ends are installed coaxially with each other.
Figure 10:
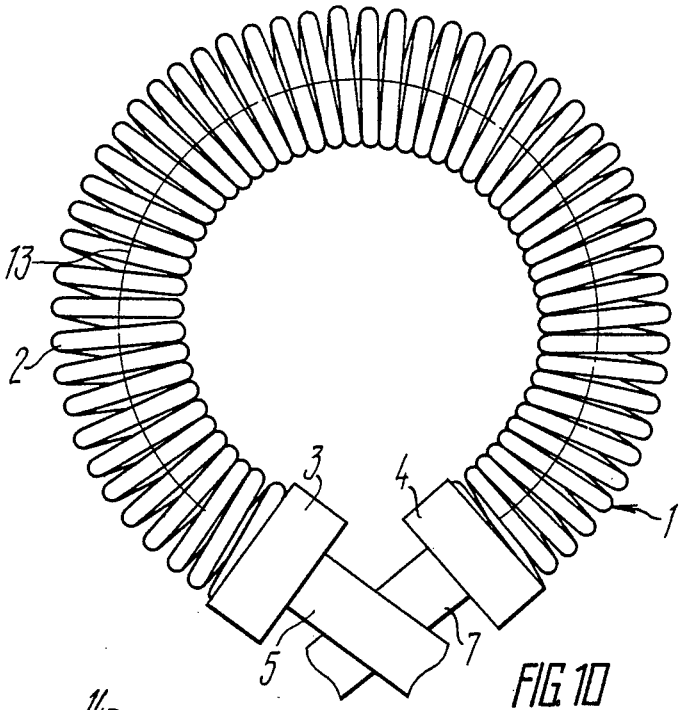
FIG. 10 illustrates a working member, wherein the center line is made in the form of a space helical line.

In each of alternative embodiments of the working members illustrated in FIGS. 8–10 the spiral 2 is installed by means of the attachment units 3, 4 on the rotating shafts 5, 7 respectively. In this case the working members have such a curvature and orientation in the space which make it possible not only to grind but also to convey the material, and also to facilitate their building in different units and process lines of acting production enterprises.

Figure 11:
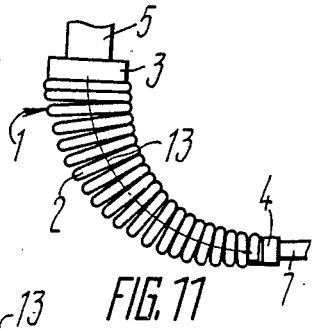
FIG. 11 illustrates a working member made in the form of a cone-shaped spiral.

An embodiment of the working member (FIG. 11) with the cone-shaped spiral 2 installed by means of the attachment units 3, 4 on the rotating shafts 5, 7 respectively provides zones in which the material to be ground is acted upon with different intensity gradually changing from one end of the working member 1 to the other one.

Figure 12:
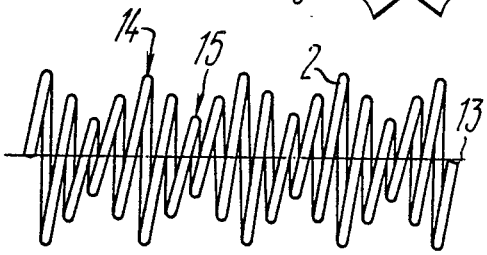
FIG. 12 illustrates a working member with a spiral whose diameter of winding is periodically changing throughout the length thereof.
Figure 13:
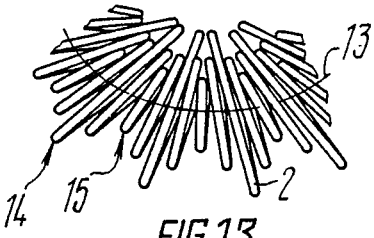
FIG. 13 same, in a curved state.
Figure 14:
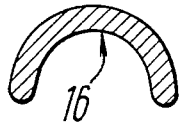
FIG. 14 illustrates a working member, wherein the coils are U-shaped.
Figure 15:
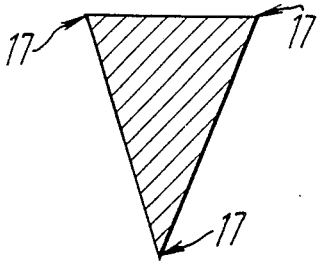
FIG. 15 illustrates a working member, wherein the coils are wedge-shaped.
Figure 19:
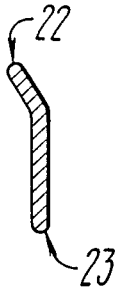
FIG. 19 illustrates a working member with one external bent edge.
Figure 20:
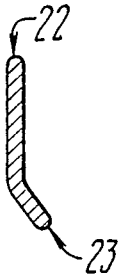
FIG. 20 illustrates a working member with one internal bent edge.
Figure 16:
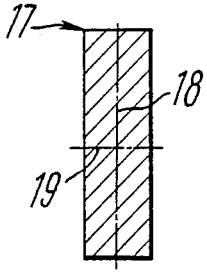
FIG. 16 illustrates a working member the spiral of which is mad of flats rectangular in cross-section.
Figure 17:
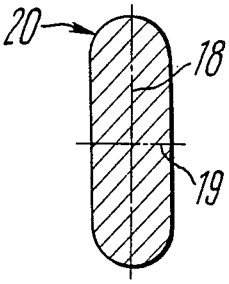
FIG. 17 illustrates a working member the spiral of which is made of flats having rounded-off edges.
Figure 21:
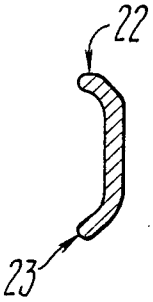
FIG. 21 illustrates a working member with two edges bent in one and the same direction.
Figure 22:
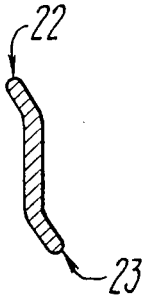
FIG. 22 illustrates a working member with two edges bent in opposite directions.
Figure 18:
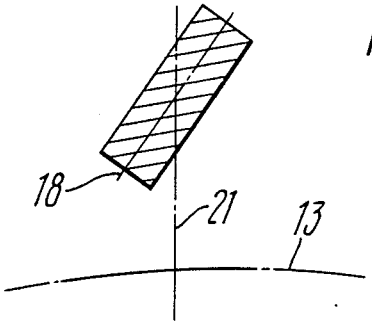
FIG. 18 illustrates a working member the spiral of which is made of flats and the longitudinal axis of section of a coil is inclined to the normal to the center line of the spiral.
Figure 23:
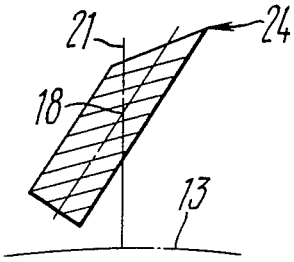
FIG. 23 illustrates a working member made of flats with a pointed edge.
Figure 24:
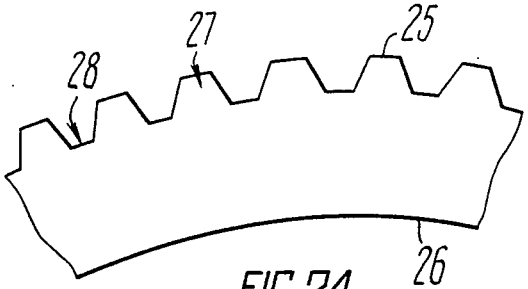
FIG. 24 illustrates an embodiment of the working member with projections and interprojection spaces provided on the external surface thereof.
Figure 27:
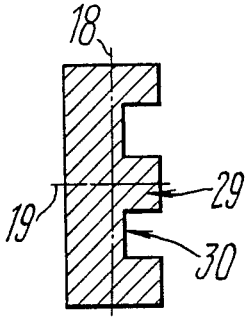
FIG. 27 illustrates an embodiment of the working member with rectangular projection and interprojection spaces provided on one of side surfaces thereof.
Figure 25:
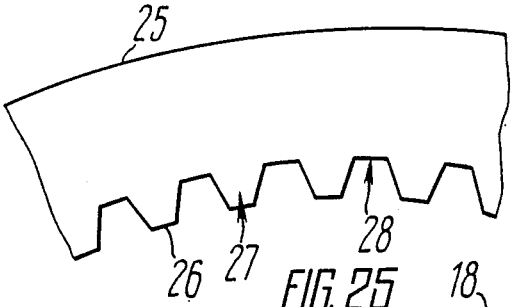
FIG. 25 illustrates an embodiment of the working member with projections and interprojection spaces provided on the internal surface thereof.
Figure 28:
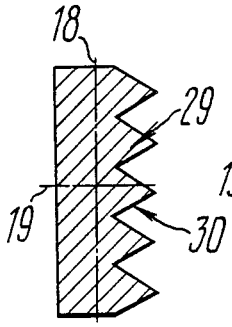
FIG. 28 illustrates an embodiment of the working member with triangular projections and interprojection spaces provided on one of the side surfaces thereof.
Figure 29:
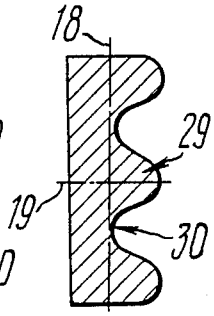
FIG. 29 illustrates an embodiment of the working member with wave-like projections and interprojection spaces provided on one of the side surfaces thereof.
Figure 26:
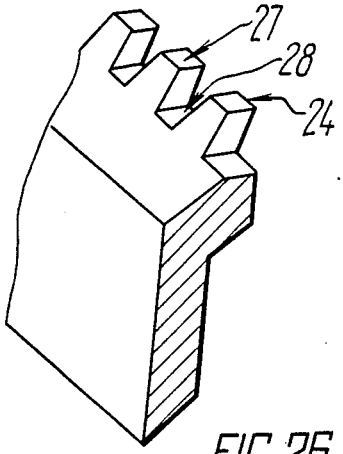
FIG. 26 illustrates an embodiment of the working member with projections and interprojection spaces provided on a bent edge.
Figure 30:
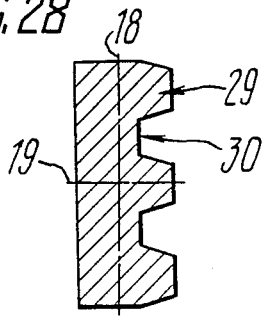
FIG. 30 illustrates an embodiment of the working member with trapezoidal projections and interprojection spaces on one of the side surfaces thereof.

A working member (FIGS. 12, 13) is made of the spiral 2 with a diameter of winding varying throughout the length thereof in the form of projections 14 and depressions 15. When the spiral is curved (FIG. 13) the projections 14 come in contact with one another, thereby forming additional dispersion zones in which the material is crushed when the spiral 2 is rotated relative to its center line 13.

Alternative embodiments of the spiral 2 of the working member with different profiles of coils in cross-section are illustrated in FIGS. 14–30.

A working member is made with U-shaped coils (FIG. 14) which may be directed by their concavities 16 to one side and inserted one inside another, and also may be directed inside or outside the spiral of the working member. In the first case the length of the line of contact is extended which causes the adjacent coils to slip one over another, thereby insuring a quality grinding of soft materials, while in the second case the adjacent coils roll one over another and break the material by way of crushing.

A working member with the wedge-shaped coils (FIG. 15) provides a linear contact between the adjacent coils and gripping of a larger amount of material. Sharp edges 17 may exert a cutting action on the material if required.

An embodiment (FIG. 16) of the working member with coils rectangular in shape also ensures gripping of a large amount of material by side surfaces of the coils. This section is characterized by a high torsional rigidity of the spiral and a low flextural rigidity, as the moduli of section are different in relation to axes of symmetry 18 and 19. Such a working member may have substantial dimensions.

A working member (FIG. 17) the spiral of which is made of flats with rounded-off edges 20 is characterized on the whole by the same properties as the preceding one. The rounded-off edges reduce the concentration of internal stresses.

A working member (FIG. 18) the spiral of which is made of flats and the longitudinal axis 18 of the coil section is inclined to a normal 21 to the center line 13 of the spiral grips the material during operation by the side surfaces of the coils and delivers it in the grinding zone. With such an embodiment of the working member the material readily passes between the coils and in large amounts is delivered for grinding.

Embodiments of the working member 1 the spiral of which is made of flats with bent edges 22, 23 are illustrated in FIGS. 19–22. Provision of only one external bent edge 22 (FIG. 19) is required for grinding viscous and clustering materials in which the working member is dipped. In this case the bent edge 22 separates the material from the mass and delivers it in the grinding zones. The same action takes place when only one internal bent edge 23 (FIG. 20) is used for grinding. In this case the material is delivered from the internal space of the spiral 2 in the wedge-shaped spaces between the coils. When edges 22, 23 (FIG. 21) are bent in one and the same direction the coils grip a large amount of material which is retained in the intercoil spaces by the bent edges. Due to this the material is subjected to self-grinding. When the edges 22, 23 are bent in the opposite directions one of the edges grips the material and the other one retains it in the intercoil spaces, the direction of bending of the edges being dependent on whether the material is delivered in or discharged from the spiral space.

A working member made of flats with a pointed edge 24 (FIG. 23) effectively undercuts the viscous and clustring materials and delivers them in the intercoil spaces. In addition the cutting edge may be used for cutting a number of materials and the side surfaces may be used for a subsequent crushing.

For crushing low-strength material through the medium of an impact action an external surface 25 (FIG. 24–26) and an internal surface 26, as well as the pointed edge 24 (FIG. 23) are provided with projections 27 and interprojection spaces 28. During rotation of the working member the projections 27 collide with the particles of material and crush them.

For crushing strong and abrasive materials projections 29 (FIGS. 27–30) and interprojection spaces 30 are made on one of the side surfaces of the spiral coils. The projections 29 may be, for example, rectangular, triangular, wave-like, trapezoidal and other in shape. At the initial stage of treatment the projections 29 effectively grip the lumps of material and break them by the splitting action and at a subsequent stage they concentrate the forces in local zones where the projections come in contact with the flat working surface.

Figure 31:
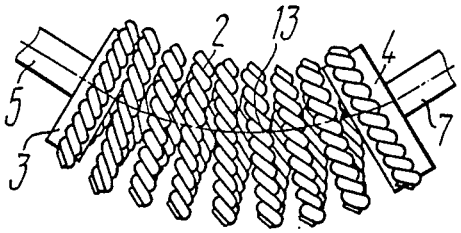
FIG. 31 illustrates a working member spiral made of a plurality of strands in the form of a wire rope.

When the spiral of a working member is made of a plurality of strands in the form of a wire rope (FIG. 31) it simplifies its manufacturing procedure and also increases its strength, as the spiral incorporates individual elements possessing a high mechanical strength.

Figure 32:
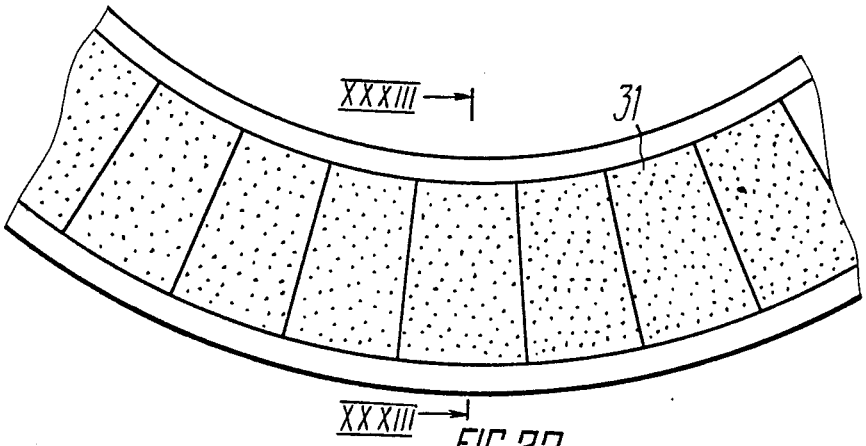
FIG. 32 illustrates a working member spiral with plates made of a wear-resistant material and installed on the side surface thereof.
Figure 33:
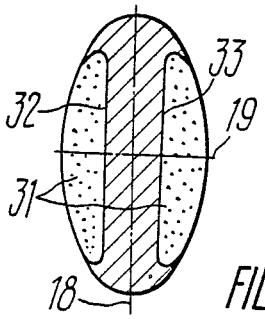
FIG. 33 is a section taken on the line XXXIII—XXXIII of FIG. 32.

For extending the durability of the working member the spiral is made with plates 31 manufactured of wear-resistant material and installed on side surfaces 32, 33 thereof (FIG. 32–33). This makes it possible to treat extra hard and strong materials and to minimize the introduction of the coil material wear products in the product under treatment.

Figure 34:
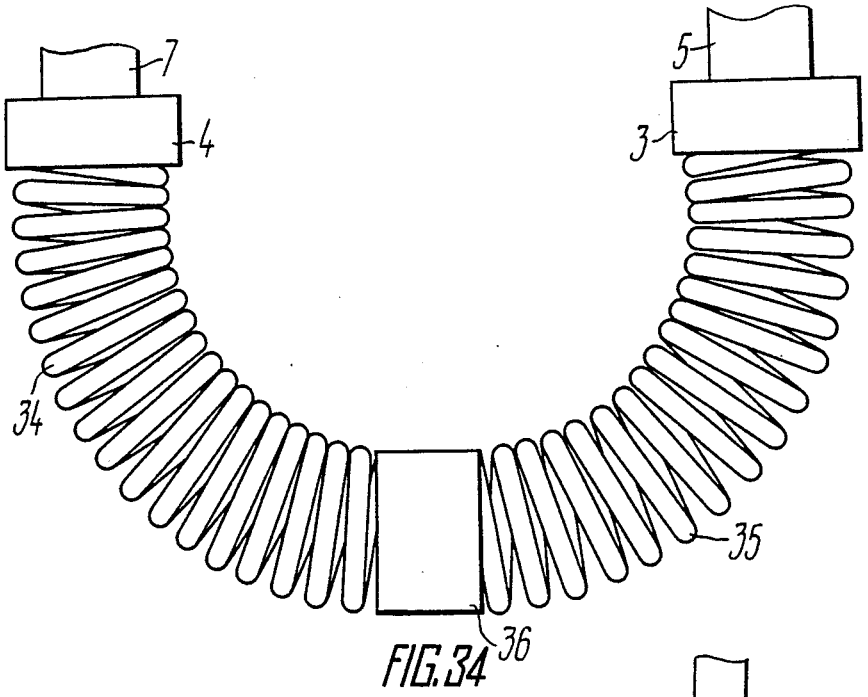
FIG. 34 illustrates a working member spiral made up of sections.

In a preferred embodiment (FIG. 34) the spiral 2 comprises spiral sections 34, 35 interconnected by an insert 36 and mounted by means of the attachment units 3, 4 on the shafts 5, 7 respectively. In this case the working member operates similarly to the working member illustrated in FIG. 1. Embodiment of the spiral 2 of the two sections 34, 35 (FIG. 34) simplifies its manufacture, as the manufacture of one section requires rolled products of smaller length.

Figure 35:
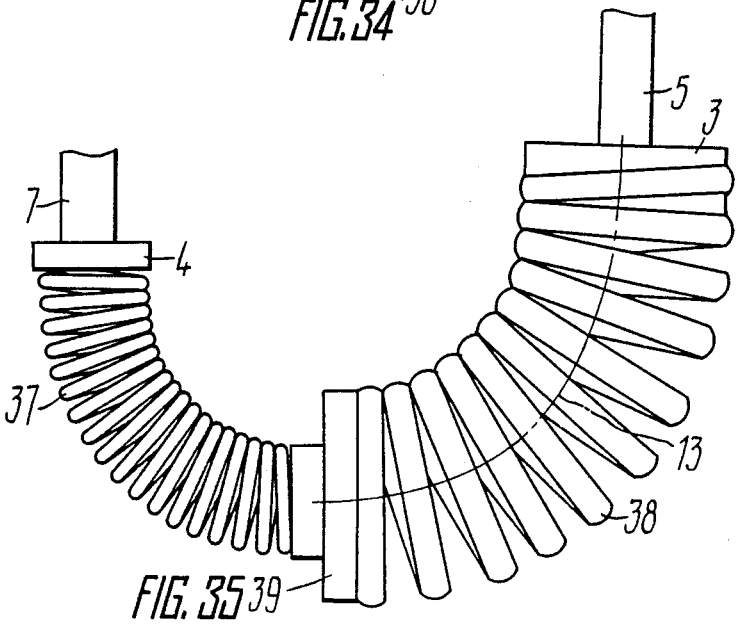
FIG. 35 same, for sections with different diameters of winding.

In an embodiment of sections 37, 38 (FIG. 35) which are different in diameter and connected by an insert 39, each of the sections 37, 38 is capable of treating the material of one or another granulometric composition. This ensures two-stage treatment of the material by one working member.

Figure 36:
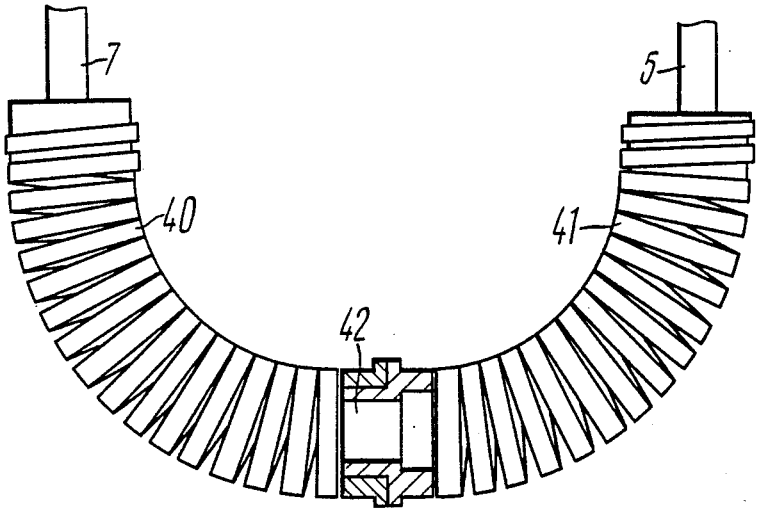
FIG. 36 same, for sections installed for relative rotation.

In an embodiment of sections adapted for a relative rotation (FIG. 36), sections 40, 41 are interconnected through the medium of a hinge joint 42. Due to this the torque is transmitted to each of the shafts 5, 7. Different rotational speeds of the shafts 5, 7 cause a relative angular movement of the sections 40 and 41 in the hinge joint 42. Embodiment of the working member comprising the two sections 40, 41 each of which is provided with an individual drive makes it possible to increase its limit of sizes, as lesser internal stresses develop in the working member due to decrease in the length of the parts thereof.

Figure 37:
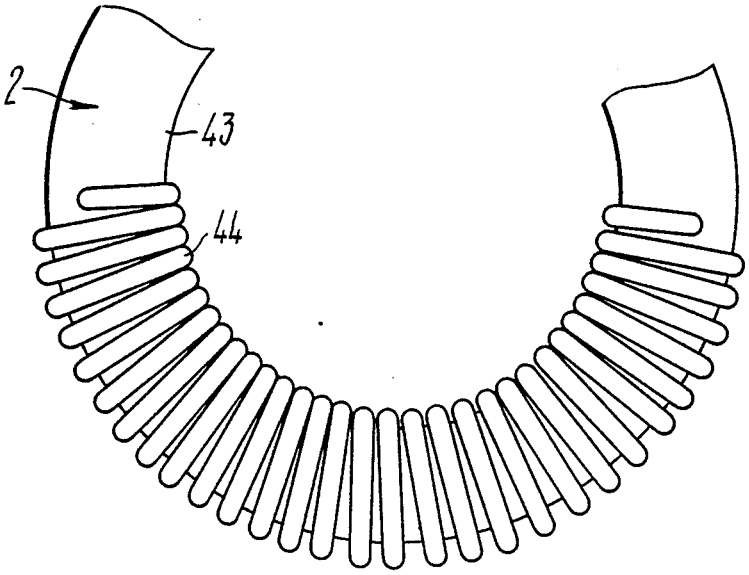
FIG. 37 illustrates an embodiment of the working member spiral with an additional spiral wound on the external surface of the body of coils.

An embodiment of the working member spiral 2 (FIG. 37) with an additional spiral 44 wound over the external surface of the coil body 43 increases the number of zones of the active treatment. When the spiral is rotated the coils of the additional spiral 44 crush the material by concentrated specific pressures. A portion of the ground material is subjected to an additional treatment between the coils of the additional spiral 44 and between the coils 43 of the spiral 2.

Figure 38:
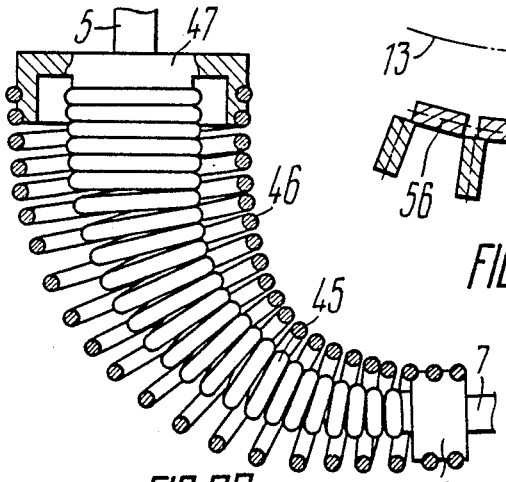
FIG. 38 illustrates a working member made up of spirals of different diameters and installed concentrically one inside the other.

In an alternative embodiment (FIG. 38) of the working member comprising spirals 45, 46 of different diameters installed coaxially one inside the other and mounted by means of attachment units 47, 48 on the shafts 5, 7 respectively the intensity of the apparatus operation is stepped up due to increase in the number of the interacting coils. The spirals 45, 46 may be made conical in shape which forms zones with a different intensity of action on the treated material throughout the length of the working member.

Figure 39:
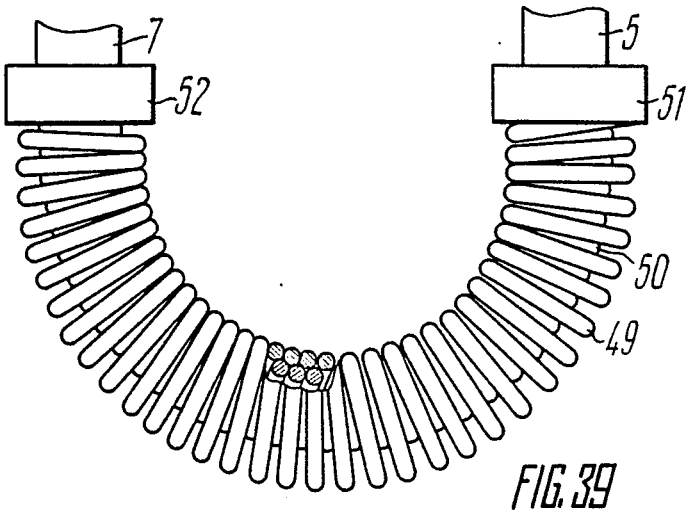
FIG. 39 illustrates a working member made up of spirals of different diameters the ends of which are installed concentric with and their central portions eccentric to each other and bear against each other.

In an embodiment of the working member (FIG. 39) comprising spirals 49, 50 of different diameters the ends of the spirals are concentrically installed on attachment units 51, 52 of the shafts 5, 7 respectively, while central portions of the spirals are eccentric to and bear against each other which increases the number of contact zones without increasing the number of spirals.

Operations of this working member is characterized in that the material is ground not only between the contacting coils of each of the spirals 49, 50 but also between the mated coils of the spirals in the central portions thereof. The force with which the central portions of the spirals 49, 50 are pressed, to each other may be regulated, for example, by changing the length of one of said spirals.

Figure 40:
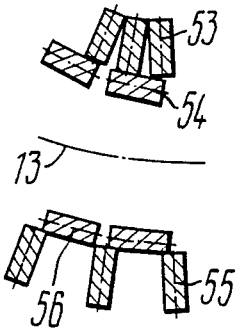
FIG. 40 illustrates working member spirals made of flats such that the longitudinal axis of section of the body coils of external spiral is normal to the center line of the working member and normal to the longitudinal axis of section of the body of coils of the internal spiral.
Figure 41:
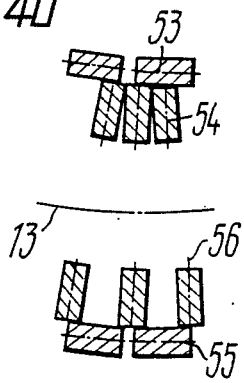
FIG. 41 illustrates working member spirals made of flats such that the longitudinal axis of section of the body of coils of the internal spiral is normal to the center line of the working member and normal to the longitudinal axis of section of the body of coils of the external spiral.

To improve the conditions for grinding a material by retaining it in the converging wedge-shaped spaces between the coils (FIGS. 40, 41), spirals 53, 54 of the working member are made such that a longitudinal axis 55 of the section of the coils of one of the spirals is normal to the center line 13 of the working member and normal to a longitudinal axis 56 of the section of the body of the coils of the other spiral. In this case, for example, two embodiments are possible. In a first embodiment (FIG. 40) the external spiral 53 is made of flats and its longitudinal axis 55 is normal to the center line 13 of the working member. In a second embodiment (FIG. 41) the internal spiral 54 is made of flats and its longitudinal axis 56 is normal to the center line 13 of the working member. In the first embodiment the operation is accomplished when the material moves inside the working member. In this case the material is crushed by the spiral 53, while the spiral 54 functions as a gate retaining the material in the crushing zones. In the second embodiment the operation is accomplished when the material moves from the working member space outside. In this case the material is crushed by the spiral 54, while the spiral 53 functions as a gate retaining the material in the crushing zones.

Figure 42:
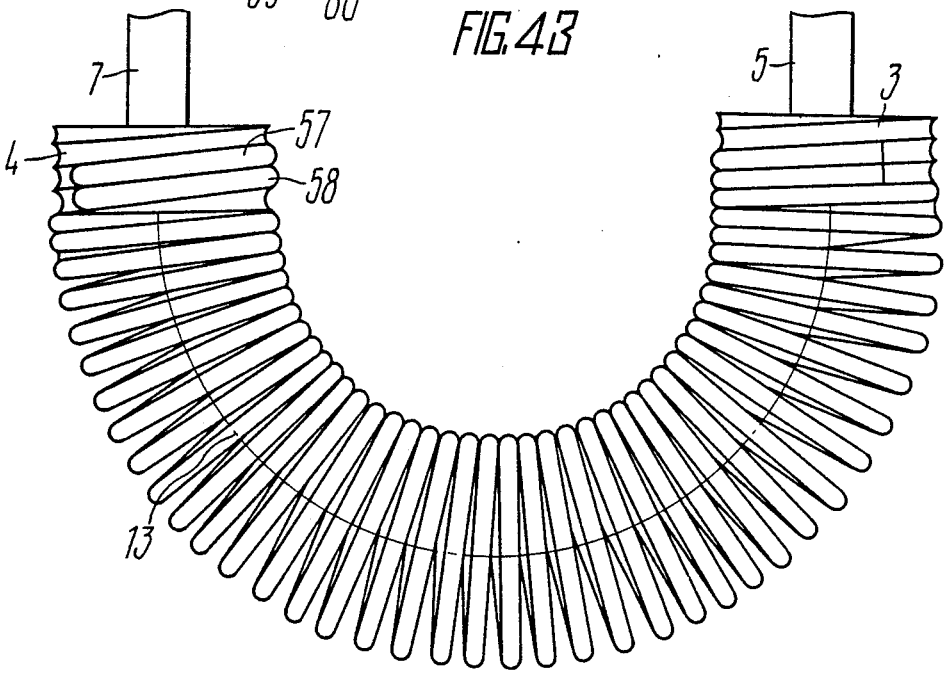
FIG. 42 illustrates a working member made of spirals equal in diameter and disposed one inside the other.

For increasing the force with which the coils are pressed to one another spirals 57, 58 (FIG. 42) are made equal in diameter and installed one inside the other, the pitch of the spirals before their assembly being different which insures during mounting an additional force compressing the coils to one another.

Figure 43:
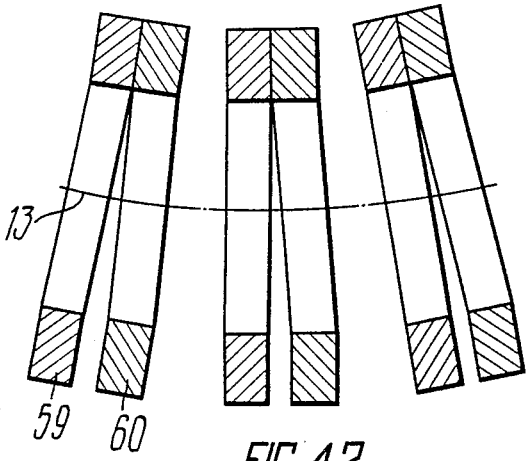
FIG. 43 is a longitudinal section of the working member the spirals of which bear against each other in the zone of the inside radius of curvature of the working member in pairs by lateral surfaces of opposite sides of the adjacent coils at one side; while at the other side there is a clearance between the lateral surfaces of the opposite sides of the spiral coils.

In an alternative embodiment of the working member (FIG. 43) spirals 59, 60 bear against each other in the zone of the inside radius of curvature in pairs by lateral surfaces of opposite sides of the adjacent coils at one side, while at the other side there is a clearance between the lateral surfaces of the opposite sides of the spiral coils. When the spirals are rotating the lump material gets in the intercoil spaces and is crushed. The given working member makes it possible to obtain a finished product of two fractions. One of the fractions incorporates very fine particles 5–10 μm and under, while the second fraction is a product with grains the maximum size of which is less than the maximum clearance between the coils on the inside radius of curvature and the minimum size is greater than the maximum clearance between the coils on the outside radius of curvature of the working member.

Figure 44:
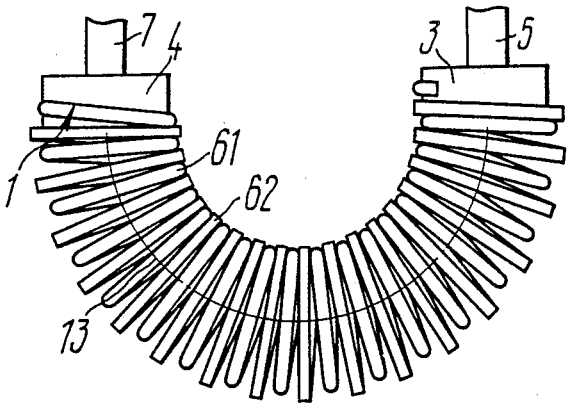
FIG. 44 illustrates a working member made up of spirals having different profiles in cross-section.
Figure 45:
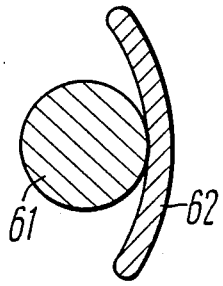
FIG. 45 illustrates an embodiment of adjacent profiles concave-convex in cross-section.
Figure 46:
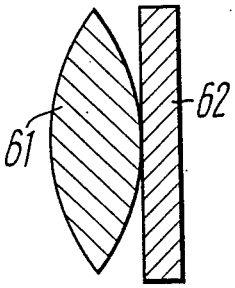
FIG. 46 illustrates an embodiment of adjacent profiles convex-flat in cross-section.
Figure 47:
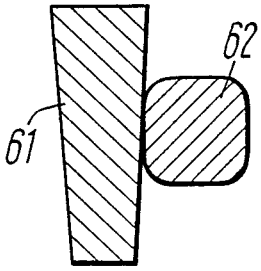
FIG. 47 illustrates an embodiment of adjacent profiles flat in cross-section.
Figure 48:
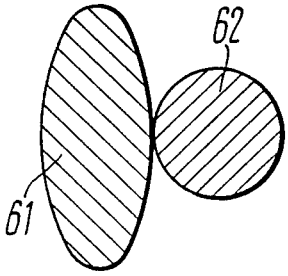
FIG. 48 illustrates an embodiment of adjacent profiles convex in cross-section.

Variation of the specific pressures at the points of contact may be achieved by making the working member of two spirals 61, 62 (FIG. 44) with different profiles in cross-section installed by means of the attachment units 3, 4 on the shafts 5, 7 respectively. In alternative embodiments the use may be made of the following main versions of contacting profiles: concave-convex profiles of FIG. 45, convex--flat profiles of FIG. 46, flat profiles of FIG. 47 and convex profiles of FIG. 48. When the coils 61, 62 are rotating a force required for squeezing the material between the coils is insured.

Figure 49:
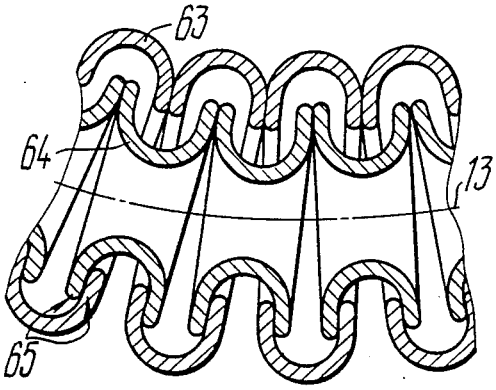
FIG. 49 illustrates an embodiment of adjacent profiles being U-shaped in cross-section the edges of which are directed towards each other and inserted one inside the other.

A working member (FIG. 49) is made of two spirals 63, 64 with U-shaped coils edges 65 of which are directed towards each other and inserted one inside the other. This makes it possible to intensify the action on the material under treatment by increasing the number of zones in which the coils come in contact with one another. In this case the coils come in contact with one another both on the inside and outside radii of curvature of the working member. The maximum clearance between the coils in this case are in the zones with a curvature equal to the curvature of the center line 13 of the working member. Through these clearances the material can leave or enter the internal space of the working member. When a wet method is used for grinding a number of materials, for example, suspensions or emulsions the product to be subjected to dispersion can fully fill all the elements of the working member and may be individually ground both in the external and internal portions thereof.

Figure 50:
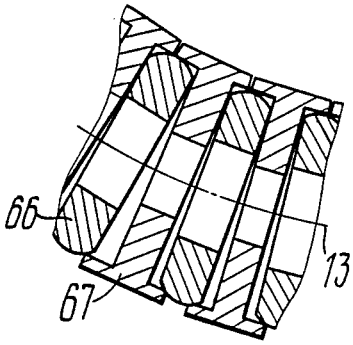
FIG. 50 illustrates an embodiment of adjacent profiles which are rectangular and double-T in cross-section, the double-T profile being disposed with its base facing outwardly.
Figure 51:
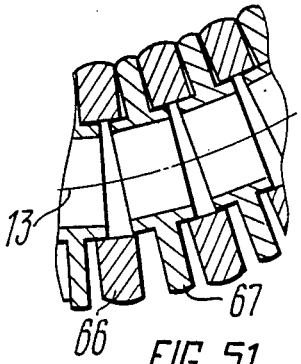
FIG. 51 same, with the double-T profile disposed with its base facing inwardly.
Figure 54:
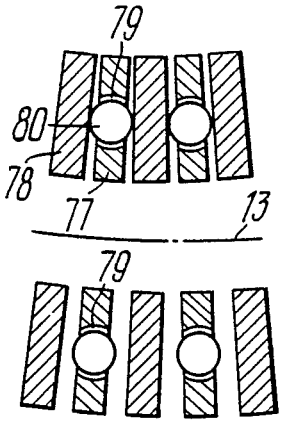
FIG. 54 illustrates a working member made of flats with one of the spirals being provided with openings internally accommodating bodies of revolution.

For increasing the dispersity of an obtained product when the apparatus is operated on the open cycle the working member may made of two spirals 66, 67 (FIGS. 50, 54) one of which has coils rectangular in cross-section and the other one has coils double-T in cross-section. If the double-T section is directed by its base outwardly (FIG. 50) the material to be ground is delivered in the working member grinding zones wherein under the action of centrifugal forces it gets in the wedge-shaped spaces between the rectangular and double-T sections. The width of the double-T section base is selected such that it completely covers the clearance between the coils of the spirals 66, 67 on the outside radius of curvature of the working member. The finished product may be discharged through a clearance between the external surface of the spiral 66 with rectangular coils and the base of the double-T sections of the spiral 67.

If the double-T section is directed by its base inwardly the material to be ground is delivered in the form of a suspension or an emulsion from the outside in the zone of action of the working member wherein it is gripped by side surfaces of the adjacent coils of the spirals 66, 67 and dispersed passing in the space of the working member through the clearances between the internal surface of the spiral 66 with the rectangular coils and the base of the double-T section of the spiral 67. The finished product is removed from the space of the working member.

Figure 52:
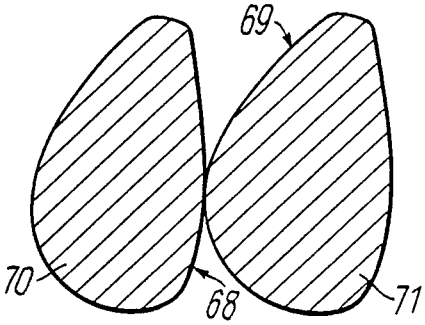
FIG. 52 illustrates an embodiment of adjacent profiles in which the side surfaces of the body of adjacent coils are profiled at least along quadratic curves and have asymmetric profiles in cross-section insuring their mutual rolling.
Figure 53:
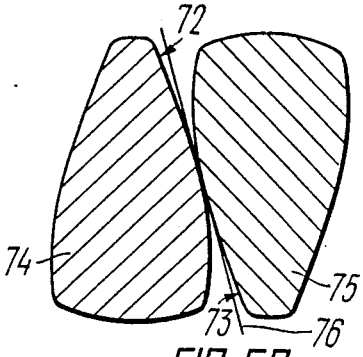
FIG. 53 illustrates an embodiment of side surfaces of adjacent coils the bodies of which are symmetric relative to the center at the point of their contact.

In order to minimize wear of the working member, side surfaces 68, 69 (FIG. 52) of mating coils 70, 71 of the spirals are profiled at least along quadratic curves having an asymmetric profile. Besides, side surfaces 72, 73 (FIG. 53) of mating coils 74, 75 may be made such that the sections of the body of coils are symmetric about the center lying at a point 76 of their contact. Mutual rolling of the sections of coils takes place when the working member is rotating which minimizes wear, noise and heating occurring during operation.

For grinding extra hard materials the working member (FIG. 54) comprises two spirals 77, 78 made of flats, one of the spirals 77 being provided with openings 79 internally accommodating bodies of revolution 80. The bodies of revolution 80 are made of a hard material.

The working member effects the grinding in the following manner. The spirals 77, 78 are put into rotation, the material is gripped by their side surfaces and delivered in the grinding zones formed between said surfaces and the bodies of revolution 80 wherein the whole of the energy is concentrated at local points and not only effects the crushing but also converts into internal energy of the material due to which the latter is activated.

Figure 55:
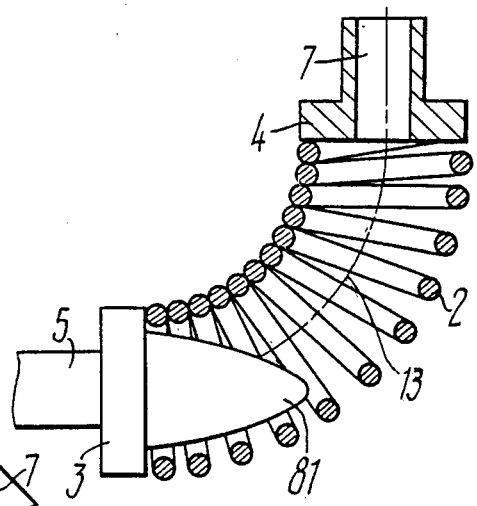
FIG. 55 illustrates an embodiment of the working member with a means for intensifying the grinding process made in the form of a cone-shaped roll installed at the end of the working member in the space thereof.

For treating a granular material of sizes greater than the clearance between the adjacent coils on the outside radius of curvature of the working member (FIG. 55) the latter is provided with a grinding intensificator in the form of a cone-shaped roll 81 internally installed in the working member and incorporating the spiral 2 installed by means of the attachment units 3, 4 on the shafts 5, 7 respectively, the shaft 7 being made hollow. The cone-shaped roll 81 is installed on the end face of the attachment unit 3. The working member grinds the material in the following way. The spiral 2 is put into rotation through the shafts 5, 7 and the attachment units 3, 4. The starting material is loaded inside the working member through the hollow shaft 7 and is ground upon getting in the clearance between the cone-shaped roll 81 and the spiral 2. Under the action of the gravitational and centrifugal forces the obtained particles of the material pass into the intercoil spaces, wherein they are subjected to finer grinding and leave the working member in the form of a fine-grained product.

Figure 57:
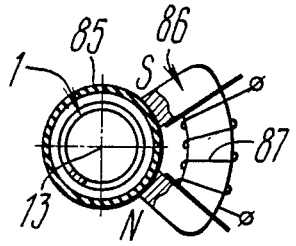
FIG. 57 illustrates an embodiment of the apparatus with application of the external force by means of a magnetic field.
Figure 58:
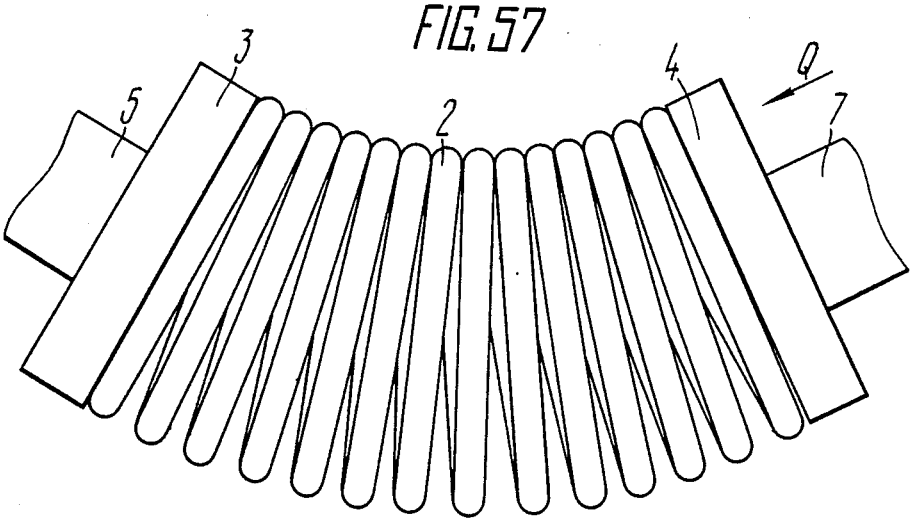
FIG. 58 illustrates an embodiment of the working member with application of an external force tangent to the center line thereof.

Control of the grinding process by way of changing the force with which the working member adjacent coils are pressed to one another is achieved through the medium of an external force to be directed along the radius towards the center of curvature of the center line of the working member (FIGS. 56, 57) or tangent to the center line thereof (FIG. 58).

Figure 56:
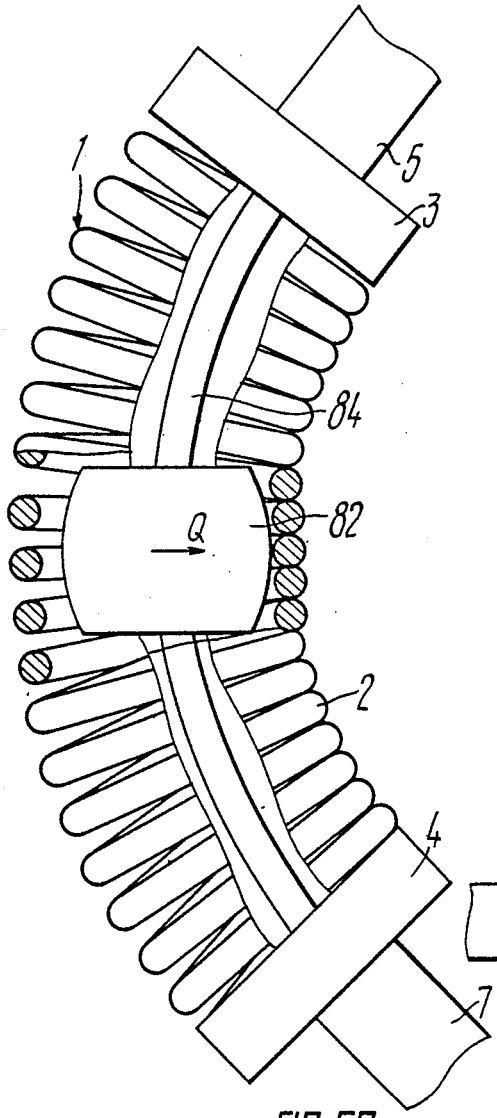
FIG. 56 illustrates an embodiment of the working member with a roller internally accommodated therein for developing an external force.

Application of the external force along the radius towards the center of curvature of the working member center line is illustrated in FIG. 56. The working member 1 comprises the spiral 2 installed by means of the attachment units 3, 4 on the shafts 5, 7 respectively and accommodating in its central portion a pressure element in the form of a roller 82 associated by means of elastic elements 83, 84 with the attachment units 3, 4 respectively.

The working member operates in the following manner. A required length of the elastic elements 83, 84 is selected, the shafts 5, 7 are turned relative to each other through an angle necessary for forming a required clearance between the adjacent coils of the spiral 2 and a force 0 for pressing the coils to one another is insured by tensioning the elastic elements 83, 84. Thereafter a rotary motion is imparted to the spiral 2 from the shafts 5, 7 through the attachment units 3, 4 respectively and said spiral is placed in the material to be treated to perform an intensive dispersion by way of crushing the particles of the material in the wedge-shaped spaces between the coils.

Application of an external force along the radius towards the center of curvature of the working member center line through the medium of a magnetic field is illustrated in FIG. 57. The apparatus in this case comprises a housing 85 made of a non-magnetic material, the working member 1 and an electromagnet 86 with poles S and N, and a coil 87, and operates in the following manner.

The material is loaded in the housing 85 and ground upon getting in the wedge-shaped spaces between the adjacent coils. For regulating the force which presses the adjacent coils of the working member 1 to one another the winding of the coil 87 of the electromagnet 86 is energized and the magnetic flux atracts the coils of the working member 1 along the radius towards the center of curvature of its center line. When the voltage applied to the winding of the coil 87 of the electromagnet 86 is smoothly increased the force which presses the adjacent coils of the working member 1 to one another gradually increases and vice versa.

Application of the external force Q tangent to the center line of the working member is illustrated in FIG. 58. The working member comprises the spiral 2 mounted by means of the attachment units 3, 4 on the shafts 5, 7 respectively. One of the attachment units 4 is installed on the shaft 7 for axial movement (the mechanism for axial movement is not shown in the drawing). The working member operates in the following manner. The working member is placed in the material to be ground and is put into rotation from the shafts 5, 7 through the attachment units 3, 4 respectively. Lumps of the material get in the wedge-shaped spaces between the coils of the spiral 2 and are ground. The intensity of this process is the higher, the greater the force Q which presses the adjacent coils to one another. This is insured by way of moving the attachment unit 4 tangent to the center line of the working member along the axis of the shaft 7.

Figure 59:
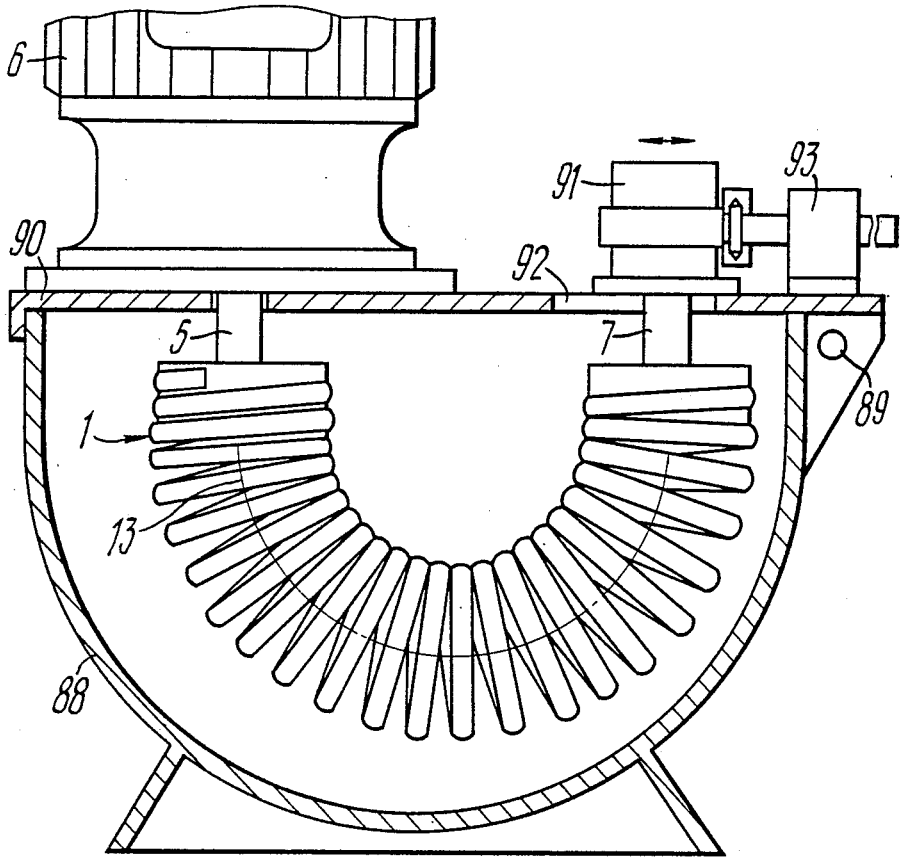
FIG. 59 illustrates an embodiment of the apparatus with a working member installed on a frame for translational motion of one of its ends relative to the other one.

An alternative embodiment of the apparatus in which the working member is installed on a support for translational movement of one end relative to the other one is illustrated in FIG. 59. Used in this apparatus as a support is a grinding chamber 88 with a cover 90 installed thereon for turning in a hinge joint 89. Secured on the cover 90 are the electric motor 6 and a bearing unit 91, the working member 1 being respectively mounted on their shafts 5, 7. The bearing unit 91 is installed on the cover 90 for translational movement in a slot 92 through the medium of a screw mechanism 93.

The apparatus operates in the following manner.

The cover 90 is raised in the upper position and the chamber 88 is loaded with a material to be ground. With the aid of the screw mechanism 93 the bearing unit 91 is set in the slot 92 such that the shafts 5, 7 are arranged at a required distance on which depends the curvature of the center line 13 of the working member 1. The smaller the radius of curvature of the center line, the greater the force which presses the adjacent coils to one another. Then the cover 90 is lowered onto the grinding chamber 88, the electric motor 6 is switched on and starts to rotate the working member 1 which grinds the loaded material. After the grinding is over, the electric motor 6 is switched off, the cover 90 is raised in the upper position and the ground product is unloaded from the chamber 88.

Figure 60:
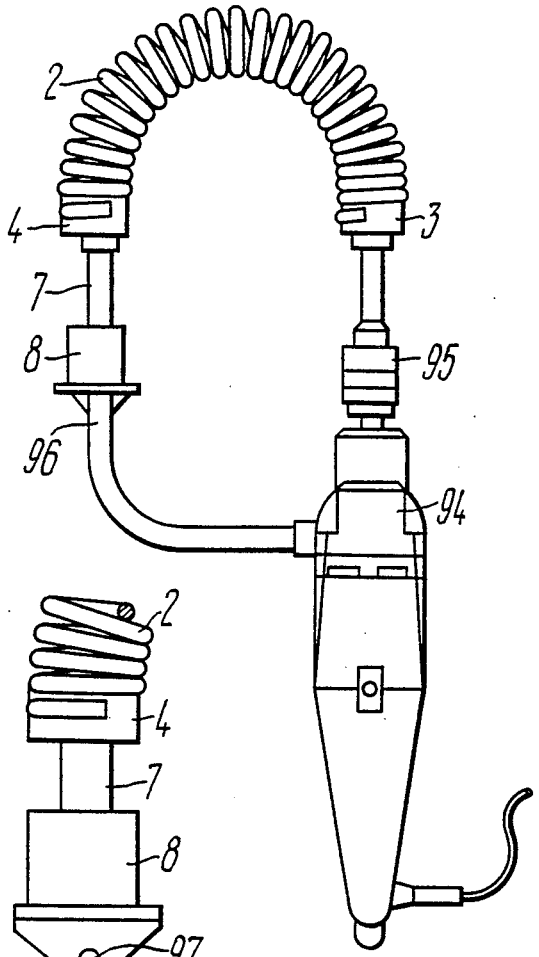
FIG. 60 illustrates an embodiment of the apparatus in which one end of the working member is secured on the shaft of a drive, while the other end is secured on the axle of an additional support fixed to a bracket rigidly associated with a drive housing.
Figure 61:
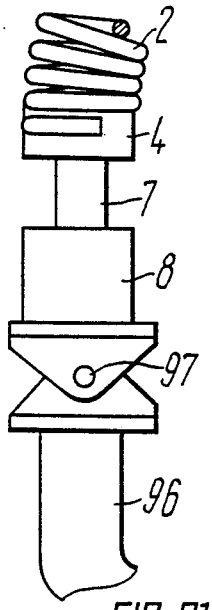
FIG. 61 illustrates a hinged attachment of the additional support axle on the bracket of the apparatus of FIG. 60.

Small amounts of materials may be ground in open vessels through the medium of an apparatus shown in FIGS.60, 61. The apparatus comprises an electric drill 94 in a chuck 95 of which the spiral 2 is mounted by means of the attachment unit 3. By means of the attachment unit 4, the other end of the spiral 2 is mounted on the shaft 7 of the support 8 installed at the end of a bracket 96 rigidly associated by its second end with the housing of the electric drill 94. The support 8 is installed on the bracket 96 for turning in a hinge joint 97.

The apparatus operates in the following manner.

The electric drill 94 is switched on and starts to rotate the spiral 2 through the medium of the chuck 95. An operator holding the whole apparatus in his hands, shifts it in a required direction and dips the spiral 2 in the material for its grinding. The presence of the hinge joint 97 in the place where the support 8 is secured to the bracket 96 makes it possible to change the central angle of the arc of the center line 13 of the working member 1 by turning the support 8. This reduces the internal stresses in the spiral 2.

Figure 62:
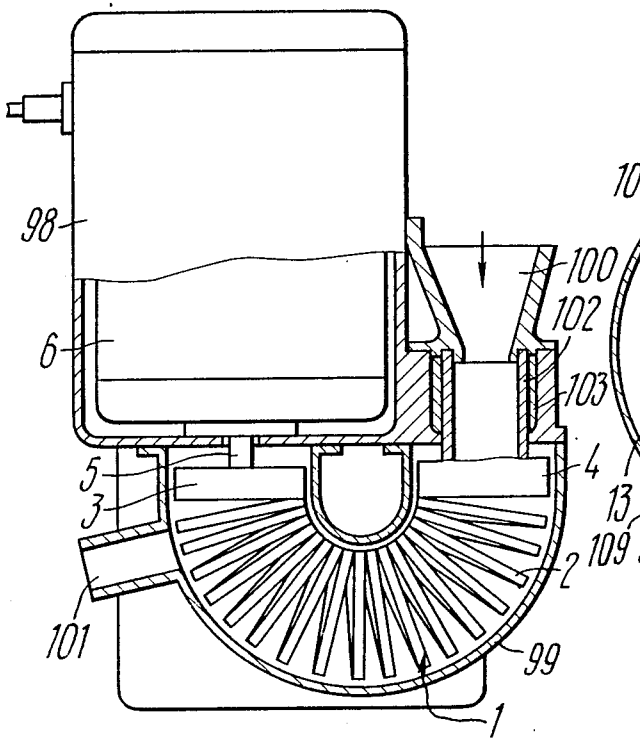
FIG. 62 illustrates an embodiment of the apparatus with a grinding chamber in the form of a tube encompassing the working member and with the loading of material inside the working member.

An alternative embodiment of the apparatus with a grinding chamber in the form of a tube encompassing the working member and with the loading of the material inside the working member is illustrated in FIG. 62.

The apparatus comprises a housing 98 with the electric motor 6 installed thereon, a grinding chamber 99, a loading bin 100, a connection 101 for unloading and the working member 1 in the form of the spiral 2 one end of which is mounted on the shaft 5 of the electric motor 6 by means of the attachment unit 3, while the other end is installed in a bushing 102 of a support 103 by means of the attachment unit 4.

The apparatus operates in the following manner. The electric motor is switched on and starts to rotate the working member 1 the interior space of which is loaded through the bin 100 with the lump material which is subjected to grinding by crushing in the wedge-shaped spaces between the coils of the spiral 2. Under the action of centrifugal forces the particles are tending to fill the clearance between the coils of the spiral 2 but the wall of the housing 85 prevents the material from leaving the grinding zone and due to the progressive winding of the spiral 2 the material is moved towards the unloading connection 101 from which it passes out in the form of a finished product convenient for further use.

Figure 63:
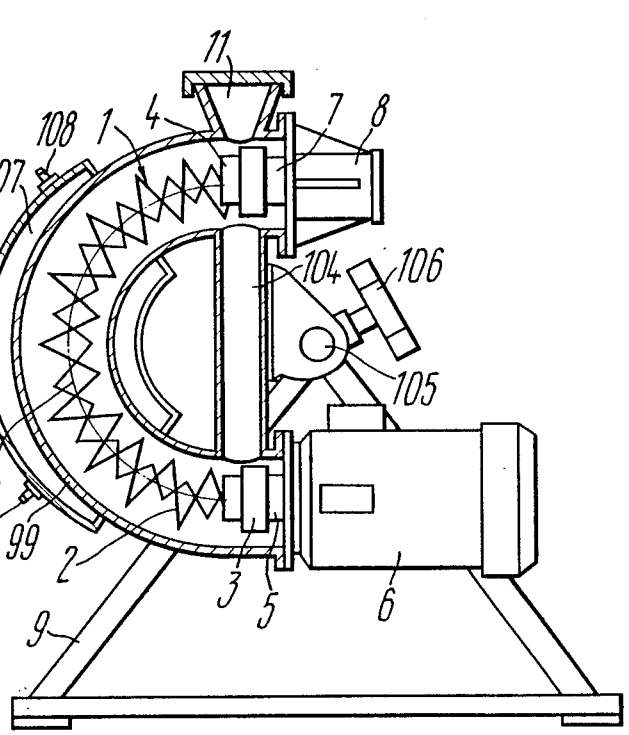
FIG. 63 illustrates an embodiment of the apparatus with a grinding chamber in the form of a tube the ends of which are interconnected by a pipeline and the chamber is installed on a frame for turning in the plane of the working member center line.

An apparatus for grinding made with a grinding chamber in the form of a tube the ends of which are interconnected by a pipeline and the chamber is installed on a frame for turning in the plane of the center line of the working member is illustrated in FIG. 63.

This apparatus comprises the frame 9, the grinding chamber 99 with the loading port 11 internally accommodating the working member 1 in the form of the spiral 2 mounted by one attachment unit 3 on the shaft 5 of the electric motor 6 and by the other attachment unit 4, on the shaft 7 of the support 8. The ends of the grinding chamber 99 are interconnected by a pipeline 104, while the grinding chamber 99 proper is installed on the frame 9 for turning in a hinge joint 105 in the plane of the center line 13 of the working member 1 and is provided with a lock 106. For maintaining the required thermal conditions of the material grinding the grinding chamber is provided with a jacket 107 having connections 108, 109 for delivering an agent either for cooling or heating.

The apparatus operates in the following manner. The electric motor 6 is switched on and starts to rotate the working member 1. The material to be ground is delivered through the leading port 11 in the grinding chamber 99, through the pipeline 104 the material is admitted in the lower portion of the grinding chamber 99 wherein it is gripped by the coils of the spiral 2 being pressed against the internal surface of said chamber under the action of centrifugal forces. A substantial portion of the material in this case gets in the wedge-shaped spaces between the coils of the spiral 2 and is ground, moving in the upper portion of the chamber 99 wherefrom under the action of gravitational forces it once again is directed in the lower portion of the chamber and the cycle is again repeated until the product of a required granulometric composition is obtained. In the process of operation of the apparatus the lock 106 holds the grinding chamber 99 against turning in the hinge joint 105. For unloading the product the lock 106 is released and the grinding chamber 99 is turned in the hinge joint 105 so that the port 11 is facing downward and the product is unloaded therefrom. If required an agent is delivered in the jacket 107 through the connections 108, 109 either for cooling or for heating.

Figure 64:
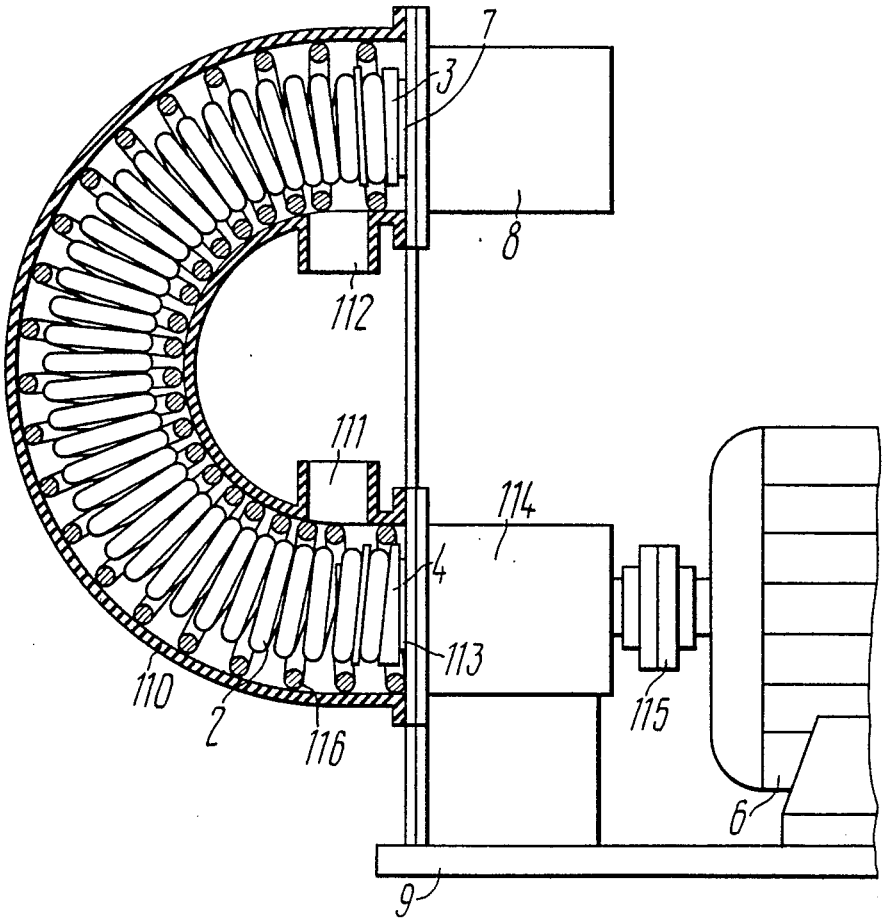
FIG. 64 illustrates an embodiment of the apparatus with a grinding chamber in the form of a tube made from an elastic material and provided with a deflecting means made in the form of a helical spiral fixedly secured on its internal surface.

An alternative embodiment of the apparatus with a grinding chamber in the form of a tube made of an elastic material with a deflecting element in the form of a helical spiral fixedly secured on the internal surface of said chamber is illustrated in FIG. 64.

This apparatus comprises a grinding chamber 110 of an elastic material installed on the frame 9 and provided with a loading connection 111, unloading connection 112, and internally accommodating a working member in the form of the spiral 2 mounted by means of the attachment units 3, 4 on shafts 7 and 113 of supports 8 and 114. The shaft 113 is associated with the electric motor 6 through the medium of a coupling 115. A stationary spiral 116 is installed on the internal surface of the grinding chamber 110.

The apparatus operates in the following manner. The spiral 2 starts to be rotated from the electric motor 6 through the coupling 115 and the shaft 113. Through the loading connection 111 the materials to be ground are continuously delivered in the form of a suspension, emulsion or a slurry in the chamber 110 wherein the material gets in the zone of action of the rotating spiral 2. As a result, a portion of the material gets at once in the wedge-shaped spaces between the coils and is dispersed, another portion of the material gets in the space of the spiral 2 and still another portion of the material gets in the space between the rotating spiral 2 and the chamber 110. In the last case, under the action of centrifugal forces the material is thrown towards the internal surface of the chamber 110 and getting on the coils of the stationary spiral 116 changes the direction of movement and is delivered onto the spiral 2 where it is subjected to dispersion. That portion of the material which is inside the spiral 2 is thrown towards the periphery and is also delivered for grinding. In the process of grinding the product is moved along the center line 13 and is unloaded through the connection 112. The particles which may stick to the internal surface of the chamber 110 and the stationary spiral 116 are removed under the action of the material flows or by tapping the external surface of the chamber 110.

Figure 65:
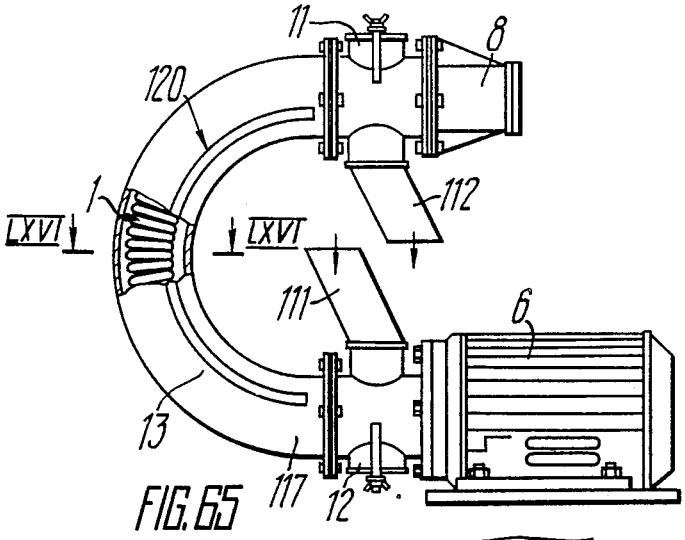
FIG. 65 illustrates an embodiment of the apparatus with a grinding chamber in the form of a tube with a deflecting means in the form of one of parallels on the housing.
Figure 66:
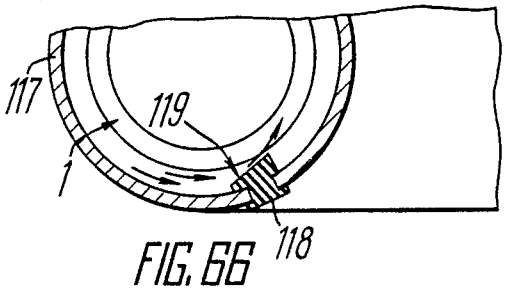
FIG. 66 same, a section taken on the line LXVI—LXVI of FIG. 65.
Figure 67:
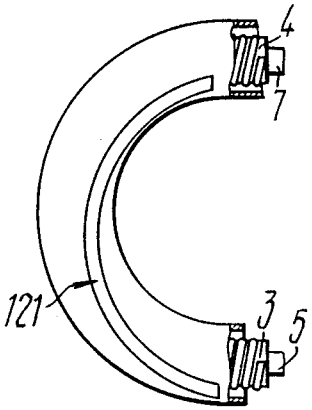
FIG. 67 same, the embodiment of a chamber with a deflecting means in the form of a loxodromic curve.

An alternative embodiment of the apparatus with a grinding chamber in the form of a tube and a deflecting element in the form of one of the parallels or a loxodromic curve is illustrated in FIGS. 65–67.

The apparatus comprises a grinding chamber 117 in the form of a tube with a loading connection 111, unloading connection 112, the ports 11, 12 installed on the frame 9 and internally accommodating the working member 1 in the form of the helical spiral 2 one end of which is installed by means of the attachment unit 3 on the shaft 5 of the electric motor 6, while the other end is installed by means of the attachment unit 4 on the shaft 7 of the support 8. A means for delivering the material in the wedge-shaped spaces between the coils of the spiral 2 is provided on the internal surface of the chamber 117. This means is a double-T element 118 with one bevelled flange 119 installed in slots made in the chamber 117 in the form of a parallel 120 or a loxodromic curve 121.

The apparatus for grinding operates in the following manner. The electric motor 6 is switched on and starts to rotate the working member 1. Through the loading connection 111 or the port 11 the material is delivered in the grinding chamber 117 wherein it is gripped by coils of the spiral 2 and moved along the circular-helical trajectories relative to the center line 13 of the working member 1. Under the action of centrifugal forces the material is thrown towards the internal surface of the chamber 117, gets on the means 118 for delivery of the material in the wedge-shaped spaces between the coils of the spiral 2 and gets therein being deflected from the flange 119. Here the material is intensively ground. In all the cases the means 118 for delivery of material insures an efficient organization of the grinding process. It is well here to observe that for a cyclic process when it is necessary to insure an extra-fine grinding the means 118 should be disposed as the parallel 120 on the chamber 117, while the loading connection 111 and the unloading connection 112 should be interconnected to form a closed loop for circulation of the material. The finished product is unloaded through the port 12. For a continuous mode of operation the means 118 should be installed in the chamber 117 along the loxodromic curve 121. This allows the product to be efficiently ground, as the grains of a definite granulometric composition are delivered in the zones between the coils of the spiral 2 corresponding in size to said grains. The ground product is unloaded through the connection 111. If required the grinding chamber 117 may be made split, for example, in the plane of the center line 13 of the working member 1. In case of wear, this will make it possible to replace not only the means 118 for delivery of material but also the spiral 2.

Figure 68:
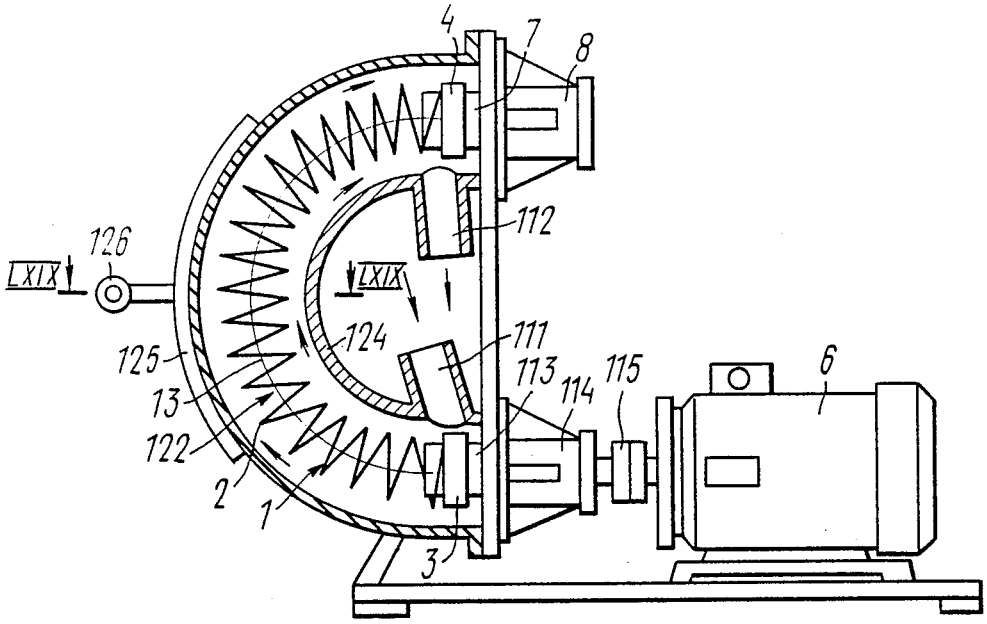
FIG. 68 illustrates an embodiment of the apparatus with a grinding chamber in the form of a tube having a portion of the wall thereof in the zone of the outside radius of curvature of the working member made of an elastic material and kinematically associated with a source of oscillations directed along the perpendicular to the center line of the working member.
Figure 69:
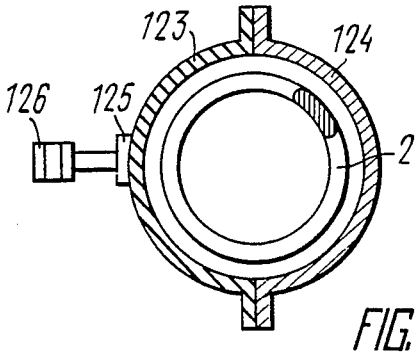
FIG. 69 same, a section taken on the line LXIX—LXIX of FIG. 69.

An alternative embodiment of the apparatus with a grinding chamber in the form of a tube wherein a portion of the wall in the zone of the outside radius of curvature of the working member is made of an elastic material and provided with a source of oscillations directed along the normal to the center line of the working member is illustrated in FIGS. 68, 69.

This apparatus comprises a grinding chamber 122 with the loading connection 111 and the unloading connection 112 installed on the frame 9 and internally accommodating the working member 1 in the form of the spiral 2 mounted by means of the attachment units 3, 4 on the shafts 5, 7 of the supports 8 and 114. The shaft 113 is associated with the electric motor 6 through the medium of the coupling 115. The chamber 122 comprises two portions 123, 124 connected with each other, the portion 123 being made of an elastic material and by means of a plate 125 and a pusher 126 is associated with the source of oscillations (not shown in the drawing) directed along the normal to the center line 13 of the working member 1.

The working process in this apparatus is accomplished in the following way. The working member 1 is rotated from the electric motor 6 through the medium of the coupling 115 and the shaft 113. The starting material is continuously delivered in the chamber 122 through the connection 111. Upon entering the zone of action of the rotating spiral 2 the particles get in the wedge-shaped spaces between the coils and are dispersed. A portion of the particles are ground at once, while a substantial portion on non-ground particles under the action of centrifugal forces are forced against the internal surface of the chamber 122 and tend to pass along the center line 13 of the working member 1 towards the unloading connection 112 in the non-ground state. For obviating this unwanted phenomenon the portion 123 of the chamber 122 is imparted with the oscillations from the pusher 126 through the plate 125, directed along the normal to the center line 13 of the working member 1. Due to this the volume of the material contained between the spiral 2 and the internal surface of the portion 123 of the chamber 122 is pushed in the sedge-shaped spaces between the coils of the spiral 2 in the zones where the clearance between the coils is at a maximum and where the material is ground. The ground product is unloaded through the connection 112.

Figure 70:
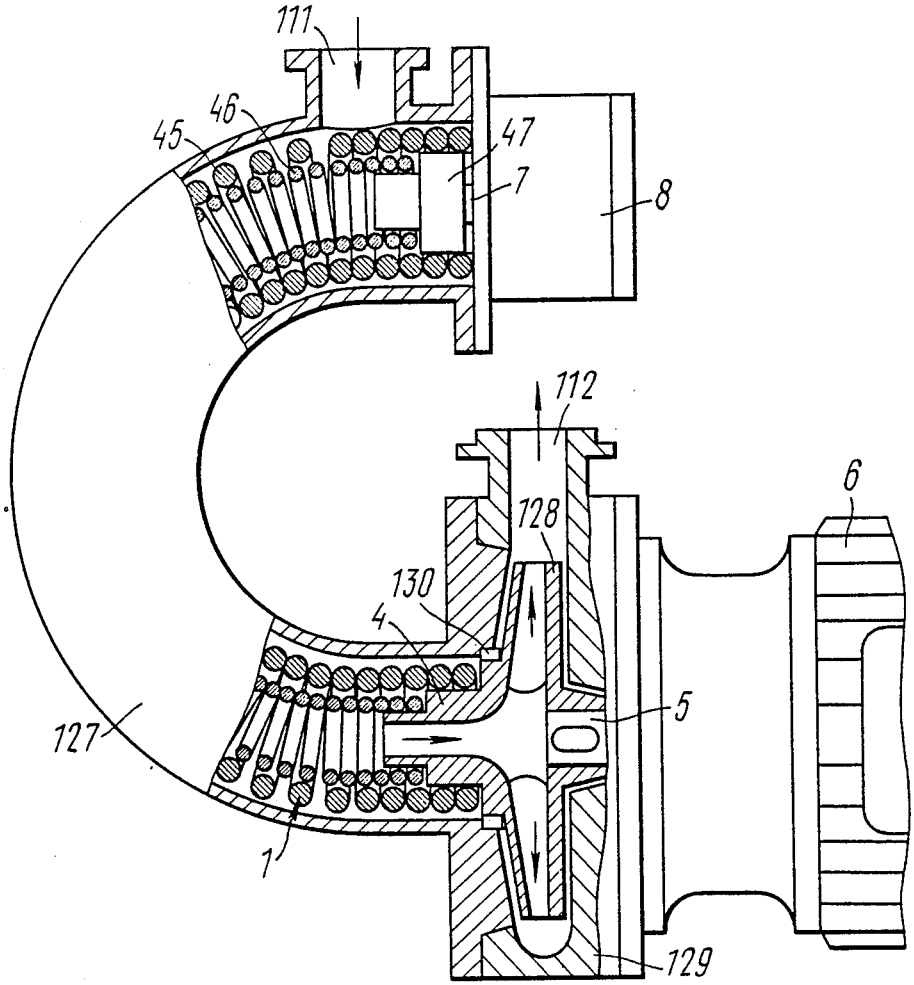
FIG. 70 illustrates an embodiment of the apparatus with a grinding chamber in the form of a tube provided with a centrifugal pump the housing of which is installed at the outlet of the grinding chamber and the impeller of which is associated with a respective end of the working member.

An embodiment of the apparatus for grinding with a chamber in the form of a tube and with a centrifugal pump the housing of which is installed at the outlet of the chamber and its impeller is associated with a respective end of the working member is illustrated in FIG. 70.

The apparatus comprises a grinding chamber 127 with the loading connection 111 and the unloading connection 112 installed on the frame 9 and internally accommodating the working member 1 in the form of two spirals 45, 46 disposed one inside the other and respectively mounted by means of the attachment units 47, 48 on the shaft 7 of the support 8 and on the end face of a centrifugal pump impeller 128. The centrifugal pump incorporates the electric motor 6 on the shaft 5 of which is mounted the impeller 128 disposed in a housing 129. A seal 130 is provided to prevent the material from passing past the spirals 45, 46.

The apparatus operates in the following manner. The electric motor 6 is switched on and starts to rotate the impeller 128 and the working member 1 through the shaft 5. A raw material in the form of a suspension, emulsion or a slurry is delivered through the connection 111 in the grinding chamber 127, sucked in by the impeller 128 and is directed in the wedge-shaped spaces between the coils of the spirals 45, 46 wherein it is subjected to an intensive dispersion. Further the ground material is forced by the impeller 128 out of the centrifugal pump housing 129 and is unloaded through the connection 112.

Figure 71:
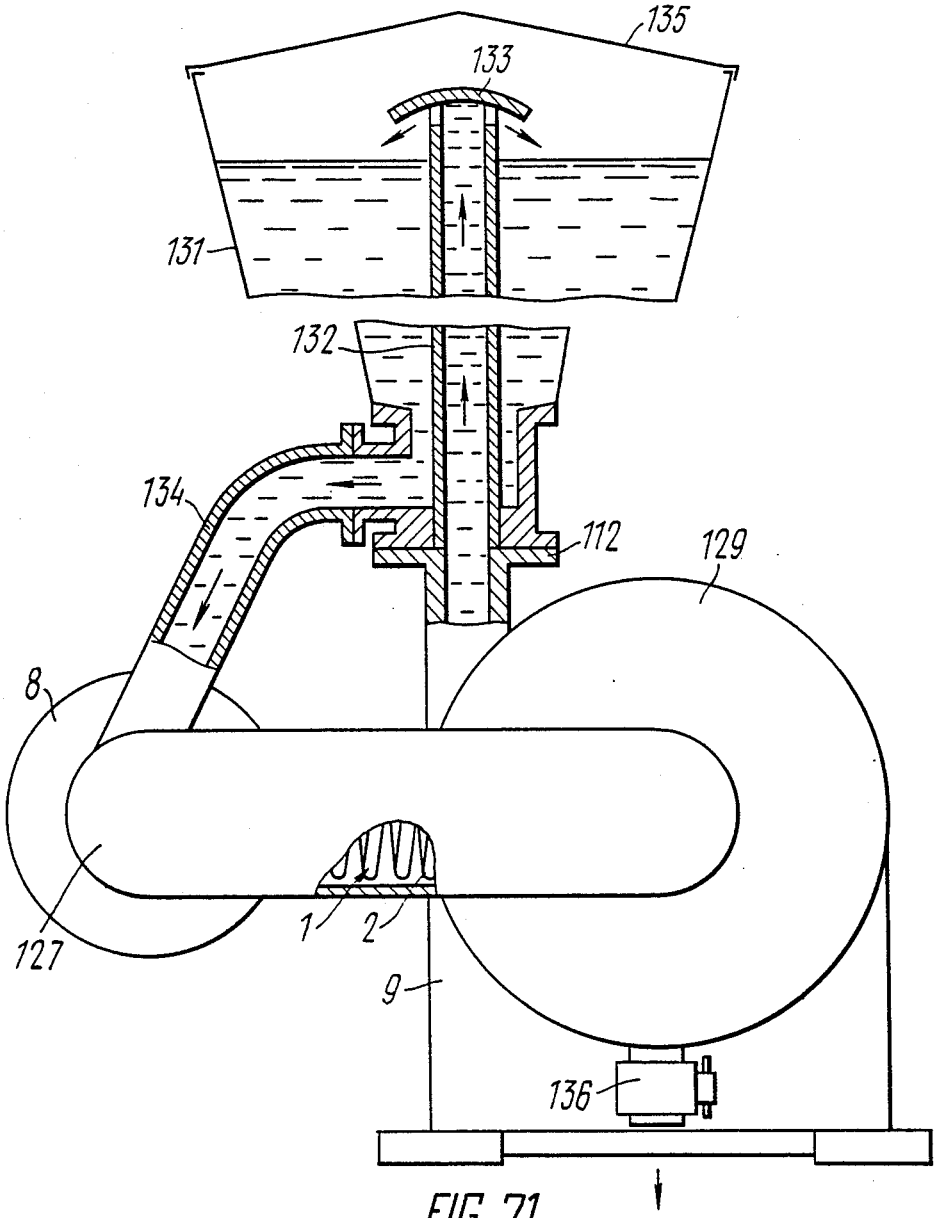
FIG. 71 illustrates an embodiment of the apparatus with a grinding chamber in the form of a tube with a centrifugal pump provided with a cone-shaped vessel disposed vertically with the cone vertex facing down.

An alternative embodiment of the apparatus with a grinding chamber in the form of a tube provided with a cone-shaped vessel with the vertex thereof facing down is illustrated in FIG. 71.

The given apparatus comprises the grinding chamber 127 with the working member 1 installed on the frame 9, the support 8 and the centrifugal pump with the housing 129 on the connection 112 of which is vertically installed a cone-shaped vessel 131 with the vertex thereof facing down internally accommodating a pipe 132 with splash guard 133 provided at the end thereof. A lower portion of the cone-shaped vessel 131 and a cantilever portion of the chamber 127 are interconnected by a pipeline 134. At the top the vessel 131 is provided with a cover 135, while the centrifugal pump housing 129 is provided at the bottom with a cock 136 for unloading the ground product.

The apparatus operates in the following manner. The cover 135 is raised up and the cone-shaped vessel 131 is filled with a liquid starting material which passes through the pipeline 134, the chamber 127 and the centrifugal pump impeller 128 which at this moment is put into rotation together with the working member 1. The material getting in the sedge-shaped spaces between the coils of the working member 1 is dispersed and at a minor excess pressure built up by the centrifugal pump is drained in the vessel 131 through the pipe 132. The guard 133 provided at the end of the pipe 132 eliminates the splashing of material. A required degree of dispersity is achieved by repeatedly passing the material through the working member 1. The product ground in this way is discharged from the apparatus through the cock 136 after its opening.

Figure 72:
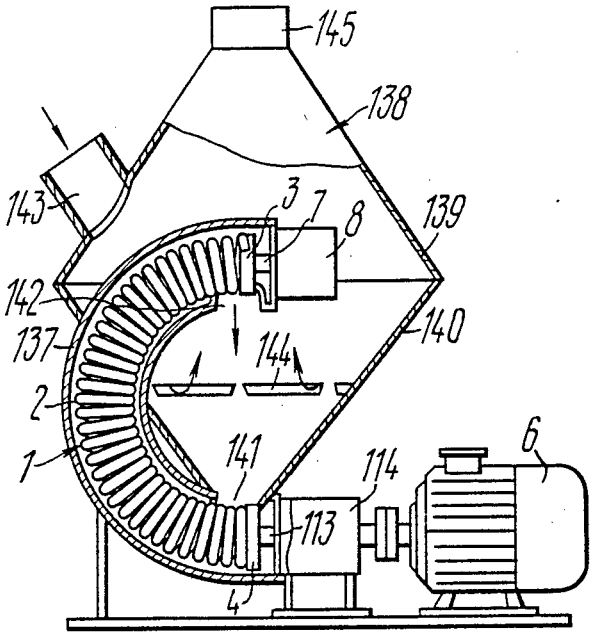
FIG. 72 illustrates an embodiment of the apparatus with a grinding chamber in the form of a tube and a separating chamber made in the form of two cones associated by their bases.

An alternative embodiment of the apparatus for grinding loose materials with a pneumatic removal of the ground fraction and with a separating chamber in the form of two cones associated by their bases is illustrated in FIG. 72.

The apparatus comprises a grinding chamber 137 in the form of a tube installed on the frame 9, a separating chamber 138 in the form of cones 139, 140 associated by their bases. An inlet 141 of the grinding chamber 137 is communicated with a lower end of the separating chamber 138 and its outlet 142 is disposed at a central portion of the bases of the cones 139, 140. The grinding chamber 137 internally accommodates the working member 1 in the form of the spiral 2 mounted by means of the attachment units 3, 4 on the shaft 113 of the support 114 and through the coupling 115 associated with the shaft 5 of the electric motor 6 and the second end is mounted on the shaft 7 of the support 8. The separating chamber 138 is provided with a connection 143 for loading a starting material, slits 144 for delivery of air and with a connection 145 for unloading the ground fraction.

The apparatus operates in the following manner. The electric motor 6 is switched on and starts to rotate the working member 1 through the coupling 115 and the shaft 113. Loose materials are delivered in a continuous flow in the separating chamber 138 through the connection 143. The finest fraction of the delivered material not subject to grinding is separated from the bulk of the material by an air flow admitted through the slits 144 and are carried away through the connection 145. A coarse fraction of the material which cannot remain in place is directed in a lower portion of the separating chamber 138 and through the inlet 141 of the grinding chamber 137 passes in the zone of action of the working member 1 and is ground by the spiral 2 moving towards its upper portion wherefrom it is poured in the central portion of the separating chamber 138. Here velocity of the air flow passing from the slits 144 to the connection 145 is at a minimum which allows an underground portion of the material to pass under the action of gravitational forces for a repeated grinding in the chamber 137 and lets the ground portion of the material flow out together with the sucked off air through the connection 145.

Alternative embodiment of grinding chambers in the form of a tube, communicated with one another in succession are illustrated in FIGS. 73–84.

Figure 73:
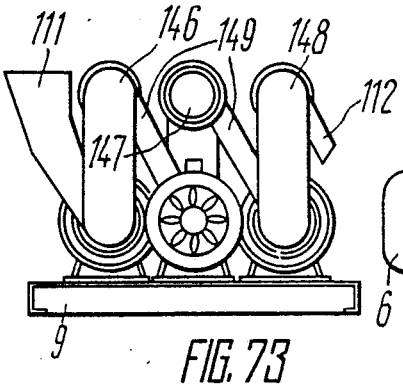
FIG. 73 illustrates an embodiment of the apparatus with the grinding chambers in the form of a tube communicated with one another in successions vertically installed and with the adjacent chambers turned relative to one another through 180°.
Figure 74:
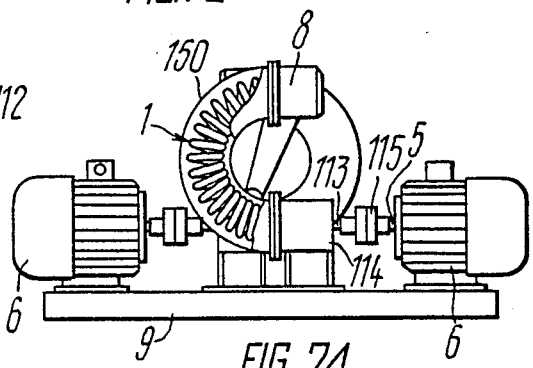
FIG. 74 same, a side view.

An alternative embodiment of the apparatus with vertically installed grinding chambers and with adjacent chambers turned relative to one another through 180° is illustrated in FIGS. 73, 74.

The apparatus comprises modules 146, 147, 148 installed on the frame 9 and communicated with one another by means of connections 149. Each of the modules incorporates a grinding chamber 150 with the working member installed on the support 8 and 114 for rotation. The shaft 113 is associated with the shaft of the electric motor 6 through the medium of the coupling 115. The connector 111 is provided for loading a starting material and the connector 112 is used for unloading the ground product.

The apparatus operates in the following manner. All the electric motors 6 of the modules 146, 147, 148 are switched on and start to rotate the working members 1. The raw material is continuously delivered through the connection 149 in the module 146 wherein it is subjected to grinding by the working member 1. Having passed the grinding cycle in the module 146, the material through the connection 149 is delivered in the module 147 wherein it is once again subjected to dispersion and thereafter passes through the connection 149 in the module 148 wherein it is finely ground and passes out through the connection 112 in the form of a finished product for further use.

Figure 75:
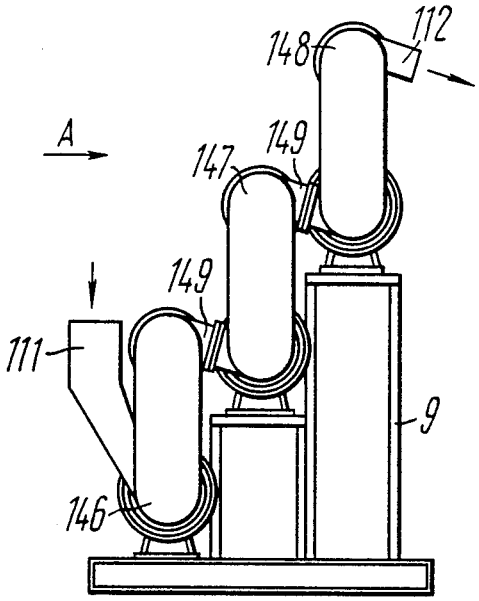
FIG. 75 illustrates an embodiment of the apparatus with grinding chambers communicated with one another in succession so that unloading ports of each of which are mated with loading ports of adjacent chambers and the chambers are parallel to one another.
Figure 76:
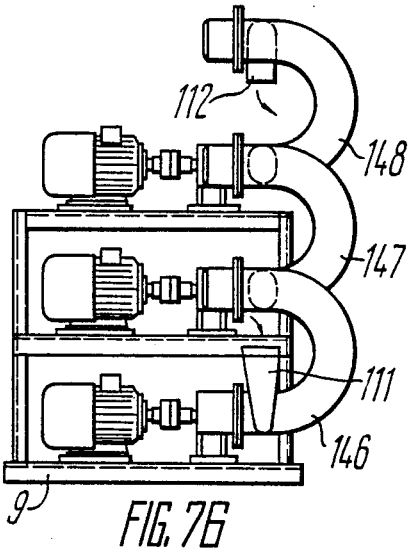
FIG. 76 same, a view along the arrow A of FIG. 75.

An embodiment of the apparatus with grinding chambers communicated with one another in succession so that unloading ports of each of which are mated with loading ports of adjacent modules and planes of middle working members are parallel to one another is illustrated in FIGS. 75, 76.

The apparatus comprises the modules 146, 147, 148 installed on the frame 9 and communicated with one another by means of the connections 149. Each of the modules is made similar to that illustrated in FIG. 74. The modules 146, 147, 148 are installed at different heights. The connection 111 is provided for loading a starting material and the connection 112 is intended for unloading the ground product.

This apparatus operates in much the same way as the apparatus illustrated in FIGS. 73, 74, the material being subjected not only to grinding but also is conveyed to a definite height. In this case the material is positively, under the action of the rotating working member 1, moved from one module into another one as the length of the connections 149 is at a minimum.

Figure 78:
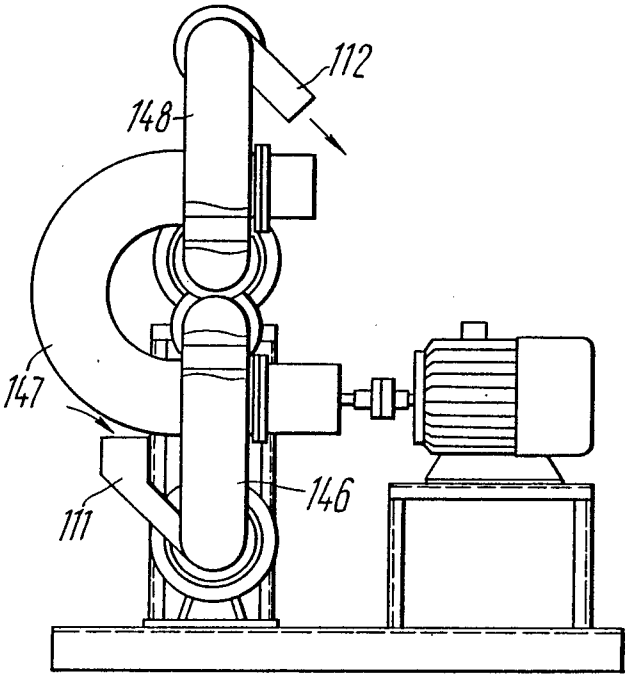
FIG. 78 same, a view along the arrow B of FIG. 77.
Figure 77:
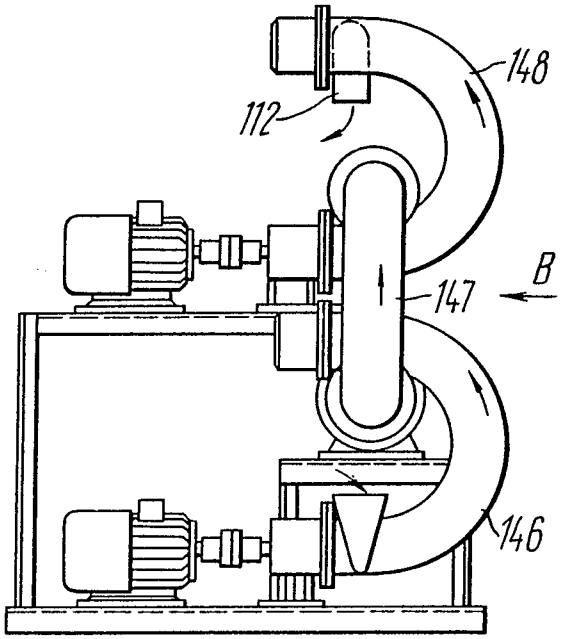
FIG. 77 illustrates an embodiment of the apparatus with grinding chambers communicated with one another in succession so that unloading ports of each of which are mated with loading ports of adjacent chambers and the chambers are perpendicular to one another.

An alternative embodiment with grinding chambers communicated with one another in succession so that unloading ports of each of which are mated with loading ports of adjacent chambers, and the adjacent chambers are perpendicular to one another is illustrated in FIGS. 77, 78.

This apparatus characterized by the same structural elements as the apparatuses illustrated in FIGS. 75, 76. The difference resides only in a relative arrangement of the modules 146, 147, 148 revolved relative to one another through 90°. Due to this the ends of grinding chambers 150 are disposed one over another which allows for an easier transfer of the material under grinding from one chamber into another one.

The working process in this apparatus is accomplished in much the same way as in the apparatus illustrated in FIGS. 75, 76.

Alternative embodiments of the apparatus with chambers connected in succession through the medium of intermediate supports are illustrated in FIGS. 79–84.

Figure 79:
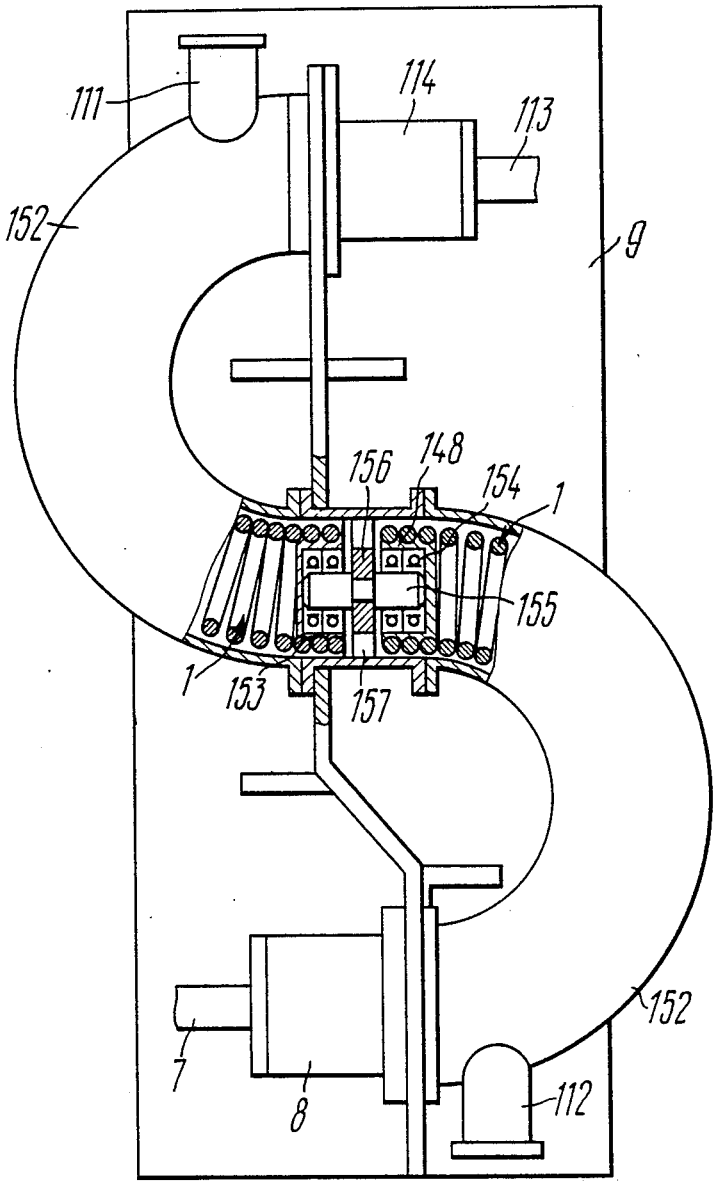
FIG. 79 illustrates an embodiment of the apparatus with grinding chambers communicated with one another in succession in the form of a zigzag line.

An alternative embodiment of the apparatus with grinding chambers connected in succession in the form of a zigzag line is illustrated in FIG. 79.

The apparatus comprises grinding chambers 151 and 152 with the loading connection 111 and the unloading connection 112 installed on frame 9. The chambers internally accommodate the working members 1 the ends of which at one side are secured in the chambers to the ends of the shafts 113, 7 of the supports 114, 8 respectively, while at the other side they are secured on supports 153, 154 installed on a stationary axle 155 of a bracket 156 with ports 157 for passage of the material.

The working process in the apparatus is effected in the following way. The working members are put into rotation through the medium of the shafts 113, 7. Through the loading connection 111 the starting material is continuously delivered in the grinding chamber 151 and is subjected to grinding by the working member 1, moving towards the second chamber 152 in which it passes through ports 157 and gets on the second working member 1 which effects the grinding and the finely ground product is unloaded through the connection 112.

Figure 80:
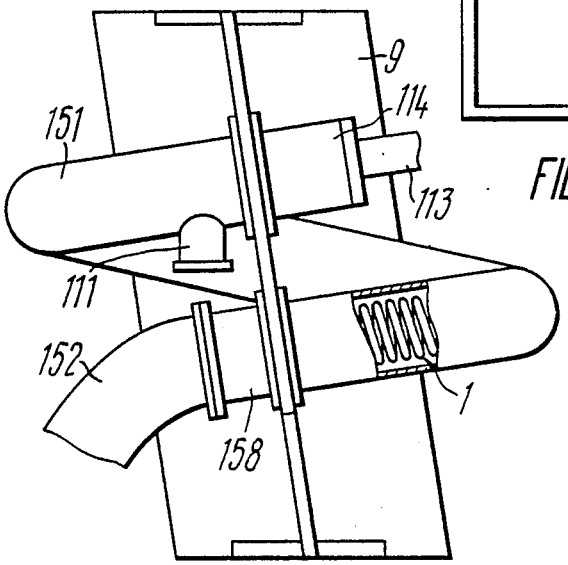
FIG. 80 same, an embodiment of the apparatus with the grinding chambers communicated with one another in succession with a space axis of the working member in the form of a portion of the helical line with an angle of the arc of the working member center line equal to 360°.

An alternative embodiment of the apparatus with grinding chambers connected in succession and with an axis of the working member in the form of a portion of a helical line with an angle of the arc of the center line of the working member equal to 360°is illustrated in FIG. 80.

The apparatus comprises the grinding chambers 151 and 152 installed on the frame 9 and internally accommodating the working member 1 mounted on supports 114 and 158 and associated with a drive through the medium of the shaft 113. For loading a raw material the chamber 151 is provided with the connection 151. The chambers 151 and 152 are interconnected by means of an intermediate support 158.

The apparatus operates in the following manner. The working member 1 is rotated by the shaft 113 and grinds the material delivered through the loading connection 111. Further the material passes through the intermediate support 158 in the chamber 152 wherein it is subjected to subsequent grinding.

Figure 81:
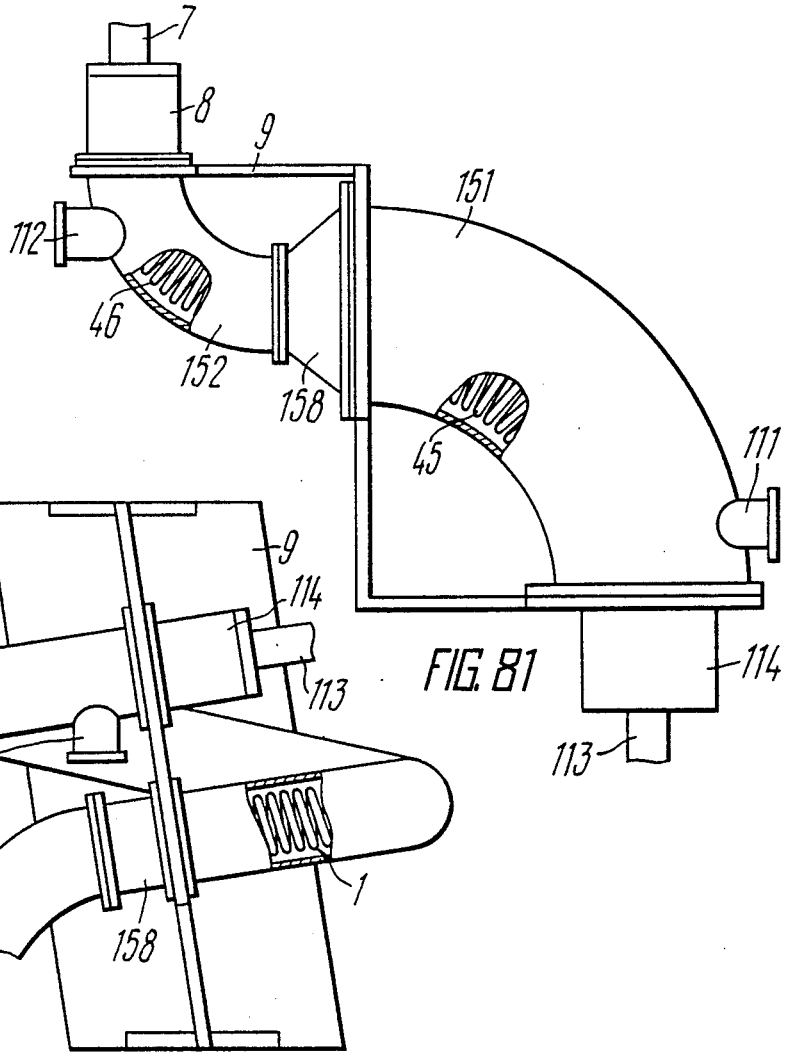
FIG. 81 same, adjacent chambers have different diameters.

An alternative embodiment of the apparatus wherein the grinding chambers are connected in succession and the adjacent chambers have different diameters is illustrated in FIG. 81.

The apparatus comprises the grinding chambers 151 and 152 installed on the frame 9 and internally accommodating the working members the spirals 45, 46 of which have different diameters. Each of the chambers is mounted on one of the shafts 113 and 7 and on the intermediate support 158.

Starting materials are loaded through the connection 111 and the ground product is unloaded through the connection 112.

The apparatus operates in the following manner. The spirals 45, 46 are rotated by the shaft 7. Through the connection 111 the raw material is delivered in the chamber 151 wherein it is ground by the spiral 45 and moves further through the intermediate support 158 in the chamber 152 wherein it is finely ground and passes out through the connection 112. The chambers 151 and 152 are used for a stage grinding characterized by that with a decrease in the size of particles the working member and the grinding chamber are also decreased.

Figure 82:
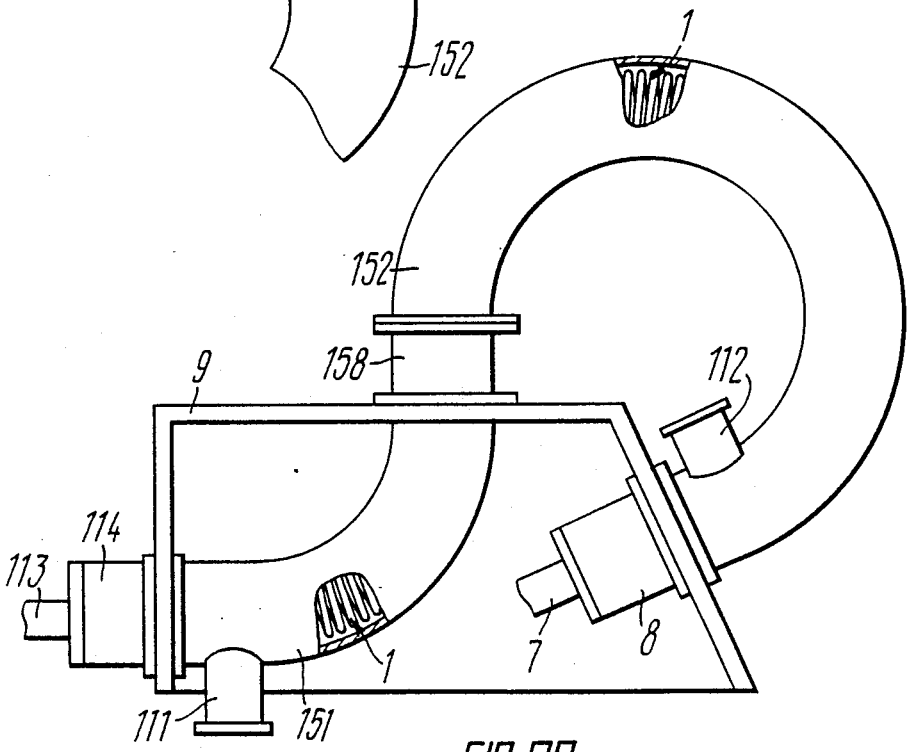
FIG. 82 same, adjacent chambers have different values of central angles of arcs of the center lines of the working members.

An alternative embodiment of the apparatus with grinding chambers connected in succession such that adjacent chambers have different central angles of the arcs of the center lines of the working members is illustrated in FIG. 82.

This apparatus has the same structural elements and operates in much the same way as the apparatus illustrated in FIG. 81.

Figure 83:
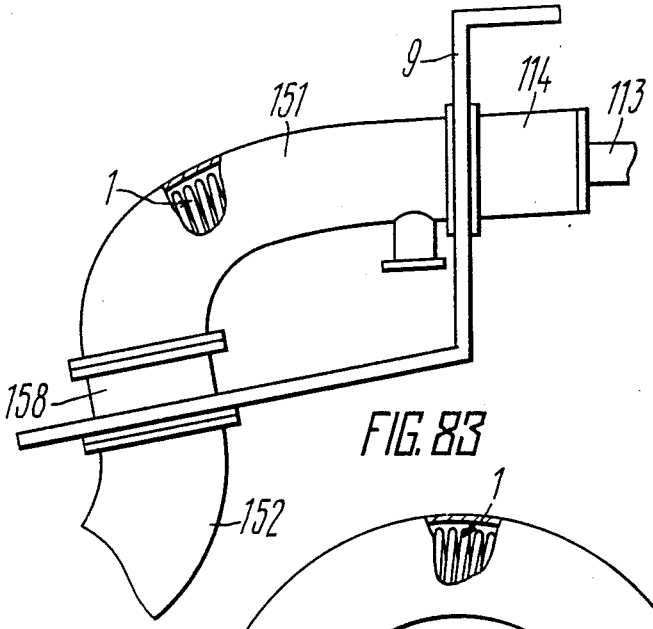
FIG. 83 same, adjacent chambers have the radii of curvature of the center lines of the working members smoothly changing.
Figure 84:
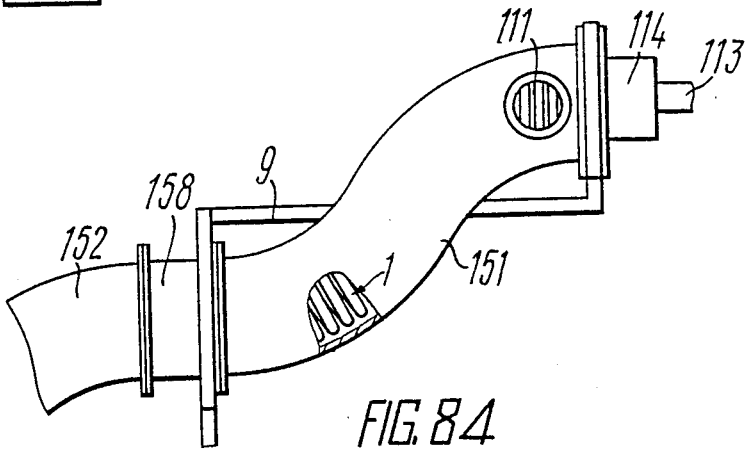
FIG. 84 same, adjacent chambers have one inflection of the center line of the working member.

An alternative embodiment of the apparatus with grinding chambers connected in succession such that adjacent chambers have smoothly changing radii of curvature of the center lines of the working members is illustrated in FIG. 83, while an embodiment of the apparatus with adjacent chambers having one inflection of the center line of the working member is illustrated in FIG. 84.

This apparatus has the same structural elements as the apparatus illustrated in FIG. 80. The working process accomplished in these apparatuses is also identical.

Figure 85:
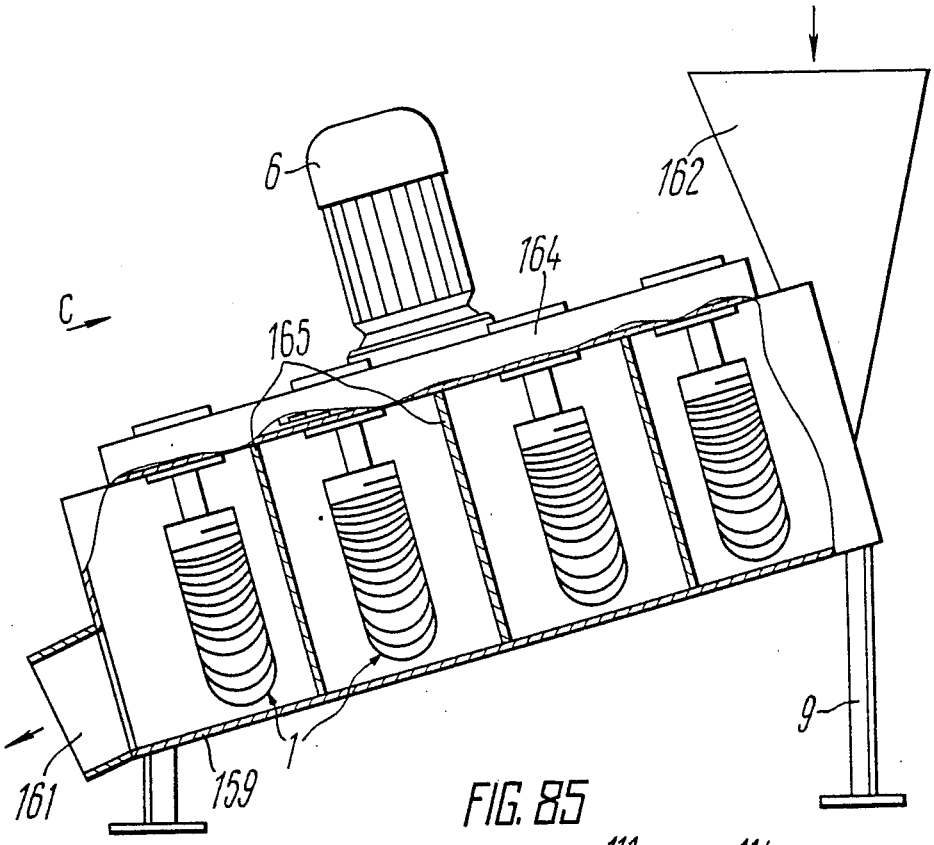
FIG. 85 illustrates an embodiment of the apparatus with a grinding chamber made in the form of a tray internally accommodating working members which are separated by partitions provided with ports.
Figure 87:
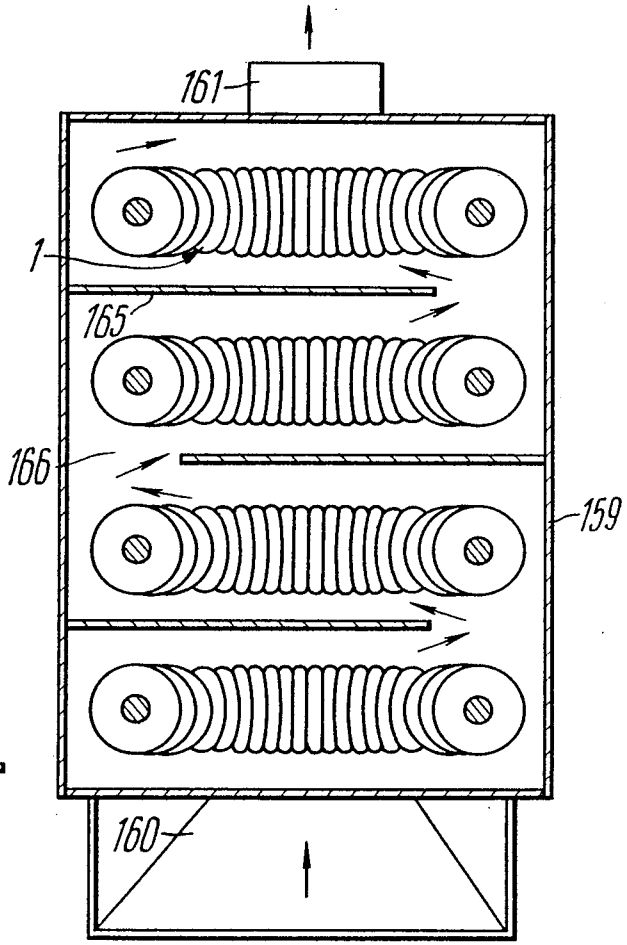
FIG. 87 same, a layout of partitions with ports in plan.
Figure 86:
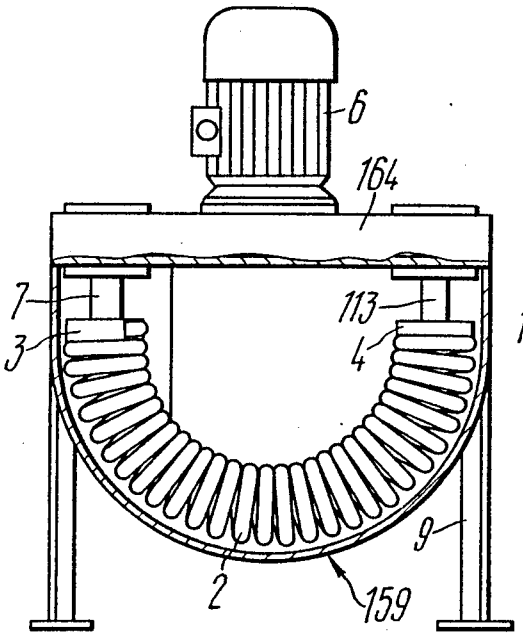
FIG. 86 same, a view along the arrow C of FIG. 85.

An alternative embodiment of the apparatus with a grinding chamber made in the form of a tray internally accommodating working members separated by partitions with ports is illustrative in FIGS. 85–87.

The apparatus comprises a grinding chamber 159 in the form of a tray with a loading connection 160 and an unloading connection 161 installed on the frame 9 and internally accommodating the working members 1 each of which is made in the form of the spiral 2 mounted by means of the attachment units 3, 4 on the shafts 7, 113 of a reduction gear 164 with the electric motor 6. The working members 1 are separated from one another by partitions 165 with ports 166.

The apparatus operates in the following manner. The working members 1 are put into rotation by the electric motor 6 through the reduction gear 164 and the shafts 7, 113. Through the loading connection 160 the starting material is continuously delivered in the grinding chamber 159 and passes in succession through all the working members 1 where it is subjected to grinding in the wedge-shaped spaces between coils. In this case the partitions 165 function as deflectors insuring the flow of material as though through a labyrinth when it passes through the ports 166. The finished product is removed through the unloading connection 161.

Figure 88:
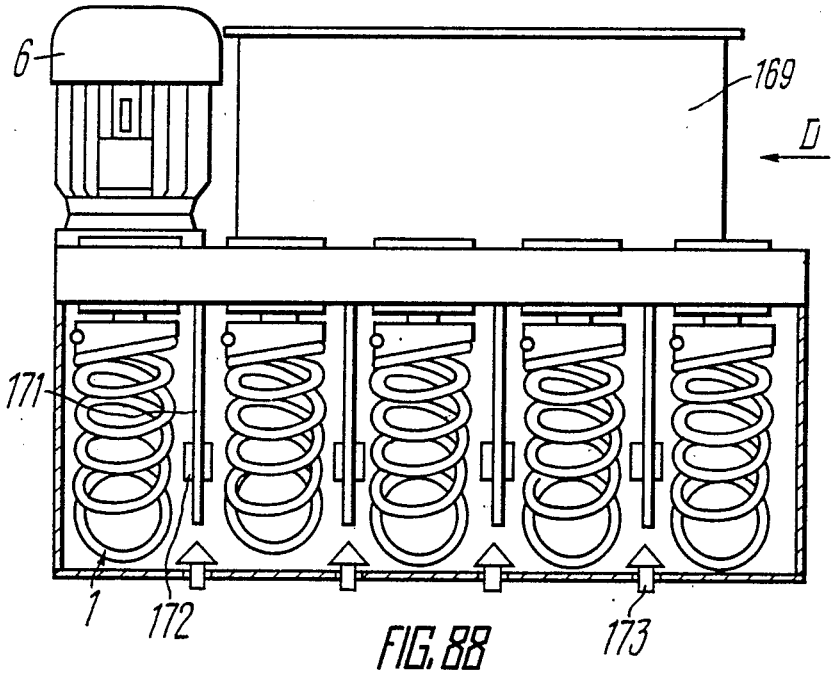
FIG. 88 illustrates an embodiment of the apparatus with a grinding chamber in the form of a tray with a cover and a connection for removal of the ground fraction, and with partitions installed in said chamber for separation of the working members and having a clearance in relation to the internal surfaces of the chamber.
Figure 89:
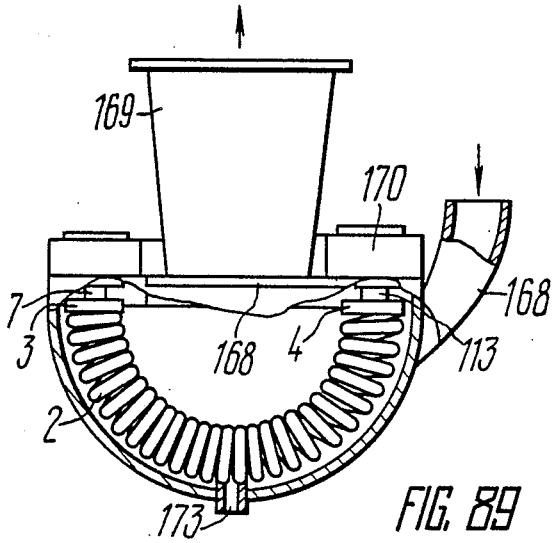
FIG. 89 same, a view along the arrow D of FIG. 88.

Alternative embodiments of the apparatus with a grinding chamber in the form of a tray provided with a cover and a connection for removal of the ground fraction and internally accommodating partitions separating the working members and having a clearance in relation to the internal surface of the chamber are illustrated in FIGS. 88, 89.

The apparatus comprises a grinding chamber 167 in the form of a tray with a loading connection 168 and an unloading connection 169 for removal of the ground fraction. Reduction gears 170 and the electric motor 6 are installed on the cover 168*a*. Mounted on the shafts 7, 113 are the working members 1 each of which is made in the form of the spiral 2 mounted by means of the attachment units 3, 4 on the shafts 7, 113 of the reduction gear 170. The working members 1 are separated from one another by partitions 171 which have a clearance in relation to the internal surface of the chamber 167 and are associated therewith by means of brackets 172. For delivery of air openings 173 with guards are provided in a bottom portion of the chamber 167.

The apparatus operates in the following manner. The electric motor 6 is switched on and starts to rotate the shafts 7, 113 with the working members 1 through the reduction gears 170. The starting components are continuously delivered through the connection 168 and on getting in the wedge-shaped spaces between the coils of the working members are ground. In this case the air flow admitted through the openings 173 carry out the ground fraction in the connection 169 for unloading, while the non-ground product and portions of a newly delivered material being in a compound motion and forming a fluidized bed are subjected to dispersing action. The air flows passing out of the openings 173 additionally contribute to directing the material in the grinding zones.

Figure 90:
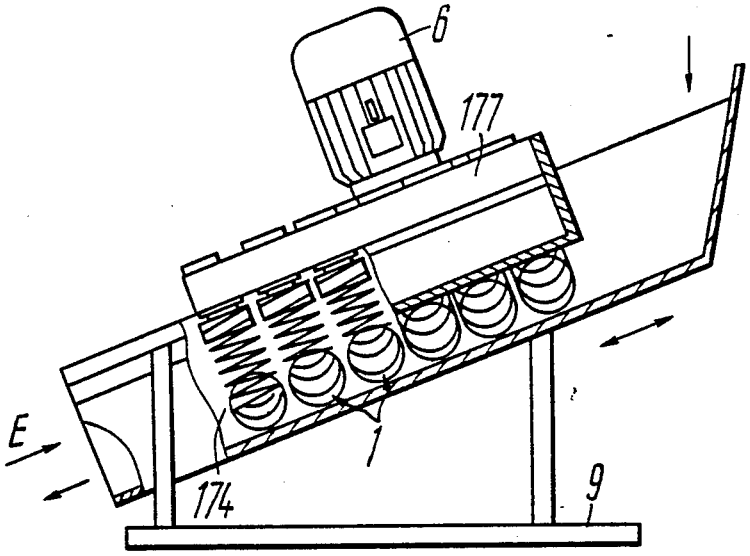
FIG. 90 illustrates an embodiment of the apparatus with a grinding chamber in the form of two concentrically disposed trays with the working members arranged therebetween.
Figure 91:
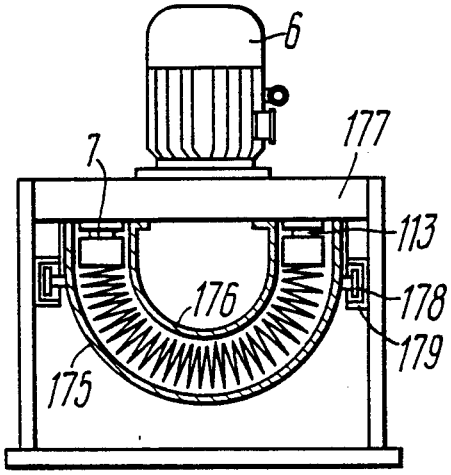
FIG. 91 same, a view along the arrow E of FIG. 90.

An alternative embodiment of the apparatus with a grinding chamber in the form of two concentrically disposed trays with the working members arranged therebetween are illustrated in FIGS. 90, 91.

The apparatus comprises a grinding chamber 174 in the form of two trays 175, 176 installed on the frame 9 and internally accommodating the working members 1 mounted on the shafts 7, 113 of a reduction gear 177 with the driving electric motor 6. The tray 175 is installed on the frame for oscillation in the direction of the axis of the chamber 174. For this purpose the tray 175 is installed through the medium of rollers 178 in guides 179. A means for imparting oscillations to the tray 175 is not shows in the drawing.

The apparatus operates in the following manner. The electric motor 6 is switched on and starts to rotate through the reduction gear 177 the shafts 7, 113 together with the working members 1 mounted thereon. The starting materials are loaded in the upper portion of the tray 175 and under the action of gravitational forces and oscillations of the tray on the rollers 178 in the guides 179 are moved in the zone of action of the working members 1 and ground to a required degree of dispersity, thereafter the product is poured from the tray 175 of the grinding chamber 174 installed with inclination. The quality of grinding is controlled by changing the angle of inclination of the grinding chamber 174.

Figure 92:
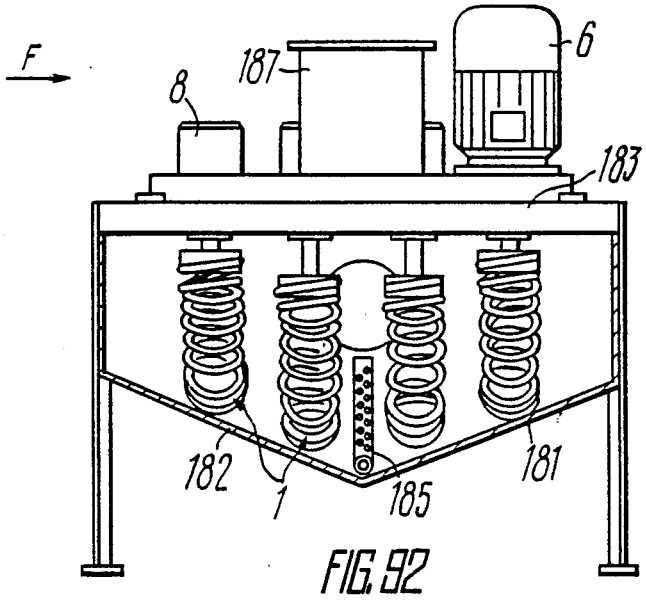
FIG. 92 illustrates an embodiment of the apparatus with a grinding chamber in the form of a tray made up of two interconnected sections the longitudinal axes of which form an obtuse angle the vertex of which is facing down.
Figure 93:
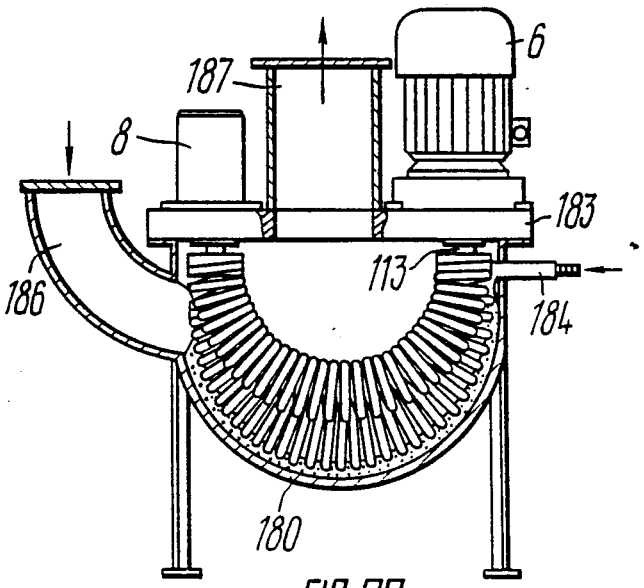
FIG. 93 same, a view along the arrow F of FIG. 92.

An alternative embodiment of the apparatus with a grinding chamber in the form of a tray made up of two interconnected sections the longitudinal axes of which form an obtuse angle with its vertex facing down is illustrated in FIGS. 92, 93.

The apparatus comprises a grinding chamber 180 in the form of a tray made up of two interconnected sections 181, 182 installed on the frame 9 and internally accommodating the working members 1 mounted on the shafts 7, 113 of a reduction gear 183 and the supports 8. For delivery of air an arc-shaped pipe 184 with openings 185 is installed at the joint of the sections 181, 182. A connection 186 is provided for loading a raw material and a connection 187, for unloading the finished product.

The apparatus operates in the following manner. The electric motor 6 is switched on and shafts to rotate through the reduction gear 183 the shafts 113 which mount the ends of the working members 1, while the other ends thereof are mounted on the shafts 7 of the supports 8. The starting material is loaded in the chamber 180 through the connection 186. While filling the chamber 180, the material gets in the wedge-shaped spaces between the coils of the working members and is ground. In this case the working members tend to uniformly spread the material throughout the volume of the chamber 1800, however under the action of gravitational forces the material is moved in the lower portion thereof. The air delivered in the pipe 184 flows out of the openings 185, entrains the ground fraction and carries it away through the connection 187. In the process of the apparatus operation the output and fineness of grinding are controlled by changing the air flow rate.

Figure 94:
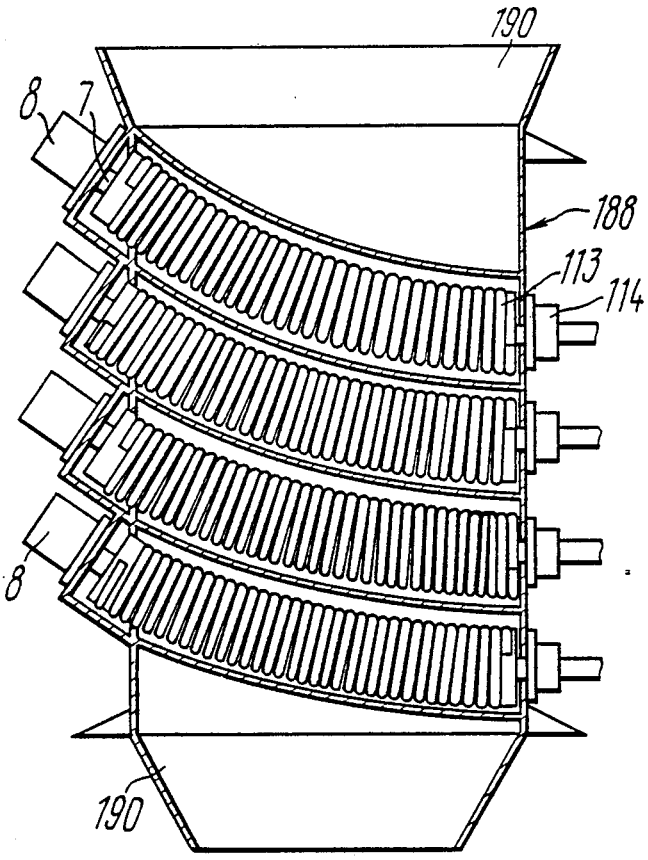
FIG. 94 illustrates an embodiment of the apparatus in the grinding chamber of which the working members are arranged one over another, lie in one plane and are separated by partitions alternately secured on the side walls of the chamber.
Figure 95:
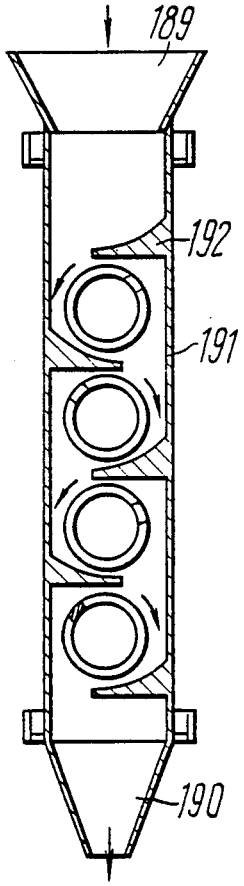
FIG. 95 same, a section taken on the line XCV—XCV of FIG. 94.

An alternative embodiment of the apparatus in the grinding chamber of which the working members are disposed one over another, lie in one plane and are separated by partitions alternately secured on the side walls of said chambers are illustrated in FIGS. 94, 95.

The apparatus comprises a grinding chamber 188 with a loading connection 189 and an unloading connection 190. The chamber 188 internally accommodates the working members mounted on the shafts 7 of the supports 8 and on the shafts 113 of the supports 114. The working members 1 are disposed one over another in one plane. Partitions 192 separating the working members 1 and having a clearance in relation to an opposite wall are secured on side walls 190, 191 of the chambers 188.

The apparatus operates in the following manner. The working members 1 are put into rotation through the shafts 113 of the supports 114. The material to be ground is continuously delivered in the chamber 188 through the connection 189. Under the action of gravitational forces and due to rotation of the working members 1 the material passes in succession on each of the working members 1 starting from the upper one where it gets in the wedge-shaped spaces between the coils and is ground. In this case partitions 192 form an original labyrinth which slows down the movement of the material from the loading connection 189 to the unloading connection 190. Under the action of the working members 1 a substantial portion of the material also moves along the partitions 192. The finished product is unloaded through the connection 190.

Figure 96:
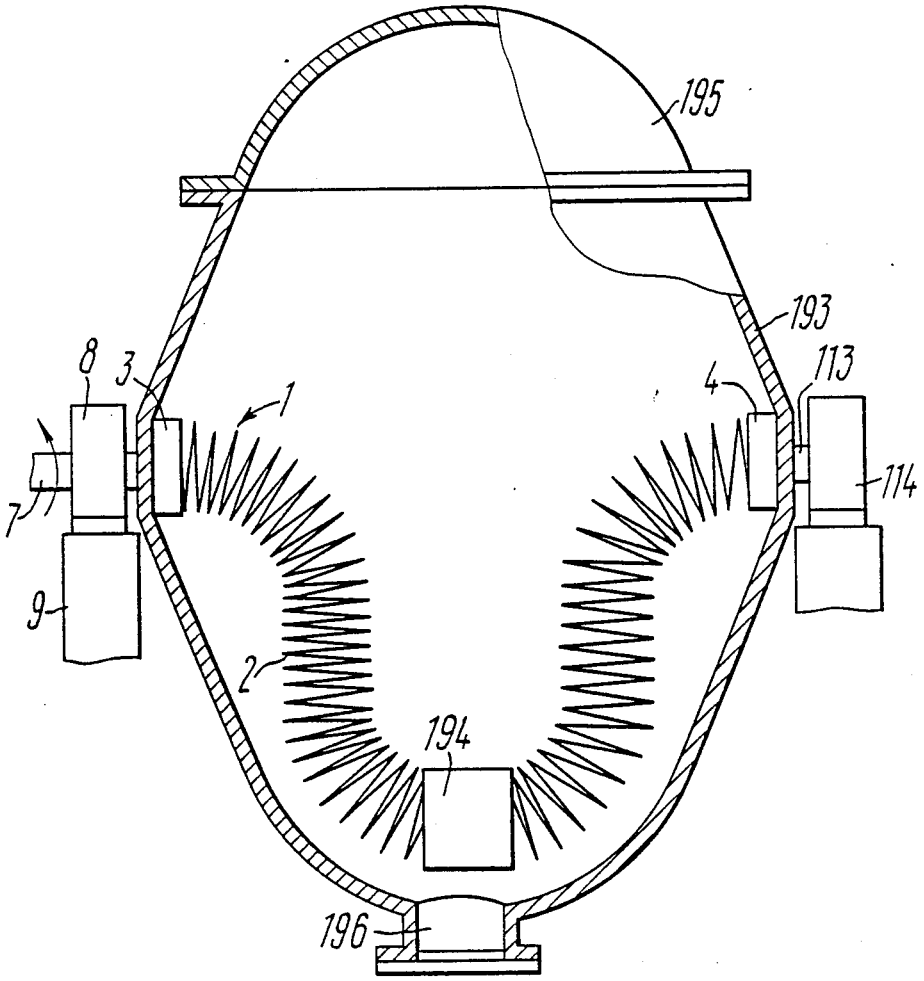
FIG. 96 illustrates an embodiment of the apparatus with a grinding chamber in the form of a drum with the working member secured on the end faces thereof coaxially with the axis of rotation and with a weight provided in the central portion of said working member.

An alternative embodiment of the apparatus with a grinding chamber in the form of a drum provided with a working member secured on end plates thereof coaxially with the axis of rotation and with a weight secured in a central portion of said working member is illustrated in FIG. 96.

The apparatus comprises a grinding chamber 193 installed on the frame on the shafts 7, 113 of the supports 8, 114. The chamber 193 internally accommodates the working member 1 in the form of the spiral 2 secured by means of the attachment units 3, 4 on the end plates of the chamber 193, the working member 1 being provided with a weight 194 in the central portion thereof. For replacing the working member 1 the chamber 194 has a cover 195, while for loading and unloading the material it has a port 196.

The apparatus operates in the following manner. Starting materials, for example, toxic and poisonous materials are loaded through the port 196 in the chamber 193, the port 196 is shut off and the chamber 193 is put into rotation from the shaft 7. Under the action of the weight 194 the working member 1 is in a stable position in the chamber 193. The working member 1 rotates together with the chamber 193 entrapping the material in the wedge-shaped spaces between the coils wherein it is dispersed. The finished product is unloaded through the port 196 after the chamber 193 has been stopped.

Figure 99:
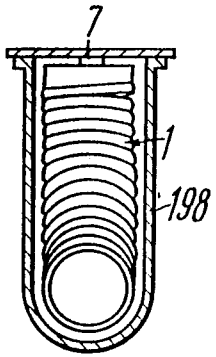
FIG. 99 same, a section taken on the line XCIX—XCIX of FIG. 98.
Figure 97:
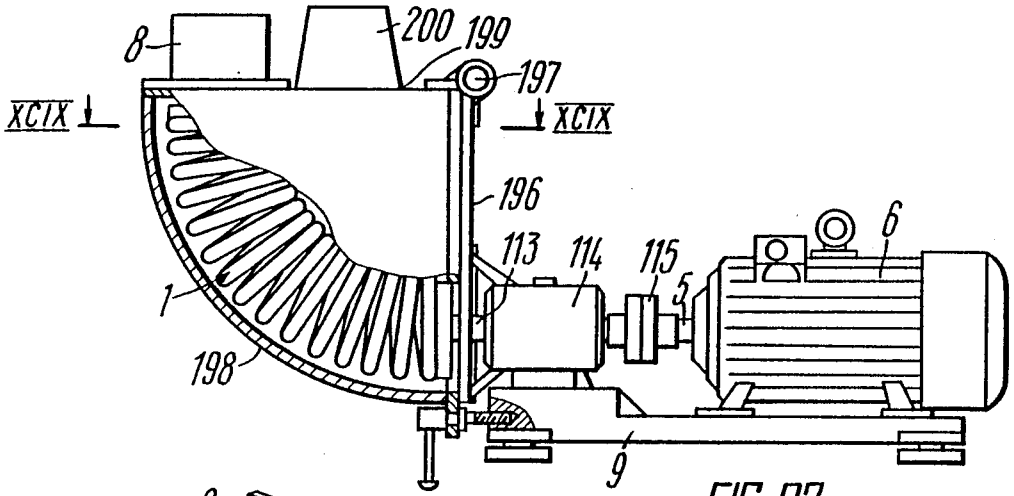
FIG. 97 illustrates an embodiment of the apparatus with a grinding chamber made by rotation of the U-shaped contour about the axis normal to the axis of symmetry of the generatrix and an end wall with a drive installed thereon.
Figure 98:
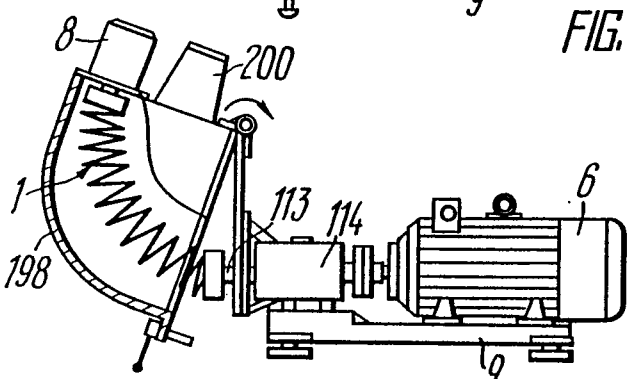
FIG. 98 same, with the grinding chamber revolved.

An alternative embodiment of the apparatus with a grinding chamber formed by rotation of a U-shaped contour about the axis perpendicular to the axis of symmetry of the generatrix and a face wall with a drive installed thereon is illustrated in FIGS. 97–99.

The apparatus comprises the frame 9 with the electric motor 6 installed thereon the shaft 5 of which is associated with the shaft 113 of the support 114 through the medium of a coupling 115. Installed on a face wall 196 of the spport 114 through the medium of a hinge joint 197 is a grinding chamber 198 formed by rotation of the U-shaped contour. An upper wall 199 of the chamber 198 is provided with the support 8 and a loading port 200. The chamber 198 internally accommodates the working member 1 mounted on the shaft 7 of the support 8 and on the shaft 113 of the support 114. For pressing the chamber 198 against the face wall 196, a screw mechanism 201 is provided in the lower portion of the chamber.

The apparatus operates in the following manner. The chamber 198 is pressed against the face wall 196 by means of the screw mechanism 201. The material to be ground is loaded in the chamber 198 through the port 200, the electric motor 6 is switched on and starts to rotate the working member 1. The material upon getting in the wedge-shaped spaces between the coils of the working member 1, is intensively ground and conveyed in the upper portion of the chamber 198 wherefrom by gravity it pours down and it once again delivered onto the working member. The cycle is repeated until particles of a required size are obtained. For unloading the chamber 198 is turned in the hinge joint 197 by means of the screw mechanisms 201 and departs from the face wall 196. All the material passes out through the formed clearance in a placed vessel not shown in the drawing.

Figure 100:
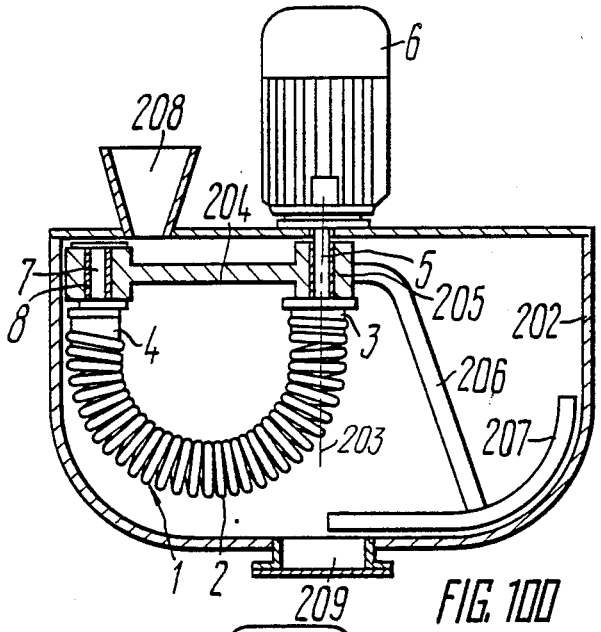
FIG. 100 illustrates an embodiment of the apparatus with a spherical grinding chamber internally accommodating the working member one end of which is associated with the shaft of a drive, while the other end is installed for a free rotation in a support disposed on a free end of the cantilever installed for rotation about the axis of the drive.

An alternative embodiment of the apparatus with a grinding chamber of a spherical shape which internally accommodates a working member one end of which is associated with the shaft of a drive, while the other end is installed for free rotation in a support disposed on a free end of a cantilever installed for rotation about the axis of the drive illustrated in FIG. 100.

The apparatus comprises a grinding chamber 202 of a spherical shape internally accommodating the working member 1 in the form of the spiral 2 associated through the medium of the attachment unit 3 with the shaft 5 of the electric motor 6 whose axis 203 coincides with the vertical axis of the chamber 202, the other end of the spiral 2 being installed by means of the attachment unit 4 on the shaft 7 of the support 8 for free rotation. The support 8 is disposed on the free end of a cantilever 204 installed for rotation about the axis 203 of the shaft of the electric motor 6 in a support 205. For obviating stagnant zones the support 205 is provided with a bracket 206 having a scraper 207 at the end thereof. For loading the starting material the chamber 202 is provided with a port 208 and for unloading the finished product it has a port 209.

The grinding process in this apparatus takes place in the following manner. The starting material is loaded in the chamber 202 through the port 208, the electric motor 6 is switched on and starts to rotate the working member 1. When the spiral 2 of the working member 1 is rotating particles are drawn in the wedge-shaped spaces between the coils and dispersed. Due to an arising reactive moment the cantilever 204 together with the working member 1 rotates about the axis 203 of the support 205 at a rotational speed which is substantially lower than the rotational speed of the shaft 5 of the electric motor 6. At this time the scraper 207 moves the material from the walls of the chamber 202 towards its center. The working member 1 uniformly grinds all the loaded material which after reaching a required degree of dispersity is unloaded through the port 209.

Figure 101:
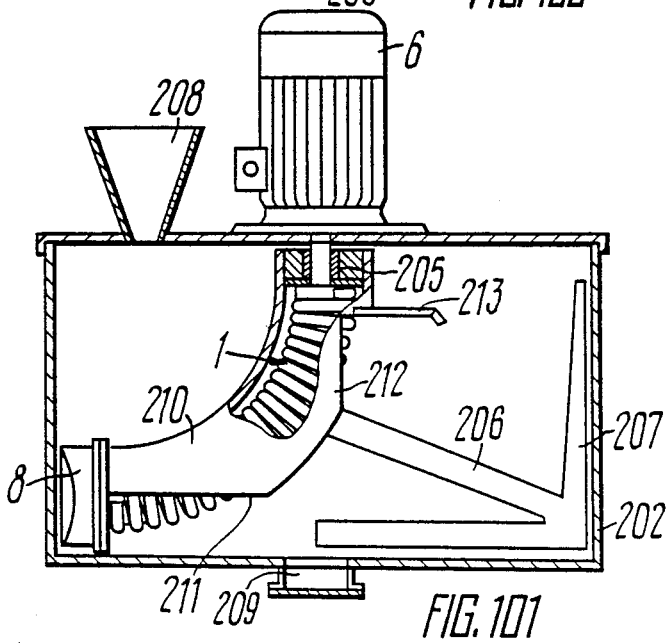
FIG. 101 same, an embodiment of the apparatus with a cantilever in the form of a tube encompassing the working member and having at its free end a port for intake of material.

FIG. 101 illustrates an alternative embodiment of the apparatus with a plurality of the structural elements already described in the preceding alternative embodiment illustrated in FIG. 100 except that the cantilever is made in the form of a tube 210 encompassing the working member 1 and provided with an intake port 211 disposed on the free end of the tube. In this case the chamber 202 is made in the form of a cylindrical vessel and the tube 210 has in its upper portion a port 212 with a deflector 213 for discharge of the material.

This apparatus operates in the following manner. The starting material in the form of a suspension, emulsion or a slurry is loaded in the chamber 202 through the loading port 208, the electric motor 6 is switched on and starts to rotate the working member 1 revolving in the supports 8 and 205 inside the tube 210. Under the action of suction effect produced by the working member 1 the starting material is drawn through the port 211 in the tube 210 and is dispersed in the wedge-shaped spaces between the coils, moving in the upper portion of the tube 210 wherefrom it passes out through port 212. The deflector 213 prevents splashing of the material in the upper portion of the chamber 202. A reactive moment arising during operation of the apparatus causes the free end of the tube 210 to rotate relative to the shaft 5 of the electric motor 6. The scraper 207 moves the material from the periphery of the chamber 202 towards the center thereof. All the loaded material is passed in succession through the working member 1 which insures a required quality of the product which then is unloaded through the port 209.

The proposed apparatus can grind different materials with Mohs' hardness from 1 to 10. The size of loaded lumps may amount to 10–20 mm and the finished product may have a size of 1–2 μm and under. The time for grinding a silica sand to particles characterized by a residue on a screen No. 005 of not over 3–5% comprises 2–3 minutes.

The proposed apparatus may be used to advantage for grinding materials.

The present invention may also be used for mechanical activation of hard materials, conducting mass transfer processes, preliminary sizing of ground loose materials as well as for grading malleable and plastic materials.

We claim:

1. An apparatus for grinding comprising a drive (6); at least one grinding working member (1) kinematically associated with said drive (6), said working member 1 being made in the form of at least one helical winding formed of spiral adjacent coils defining a center line curved along an arc and associated with said drive (6) for rotation about said center line (13), adjacent coils of said working member (1) being contiguous with one another on an inside radius of curvature of the working member (1) at least on one portion of the length thereof.

2. An apparatus according to claim 1, characterized in that a central angle of the arc of the center line (13) of the working member (1) is essentially in a range of 1° to 360°.

3. An apparatus according to claim 1, characterized in that the center line (13) of the spiral (2) of the working member (1) has at least one point of inflection.

4. An apparatus according to claim 1, characterized in that the center line (13) of the spiral 2) of the working member (1) is made in the form of a space curve.

5. An apparatus according to any of claims 1 to 4, characterized in that the spiral (2) of the working member (1) has the diameter of winding smoothly varying from one end of the working member (1) towards the other one.

6. An apparatus according to any of claims 1 to 4, characterized in that the spiral (2) of the working member (1) has the diameter of winding periodically varying throughout the length of said spiral.

7. An apparatus according to Claim 1, characterized in that the spiral coils have an U-shaped section.

8. An apparatus according to claim 7 characterized in that edges (65) of the section of the adjacent coils of spirals (63, 64) are directed towards each other and inserted one inside the other.

9. An apparatus according to claim 8 characterized in that edges (65) of the section of the adjacent coils of spirals (63, 64) are directed towards each other and inserted one inside the other.

10. An apparatus according to claim 1, characterized in that coils of the spiral (2) are wedge-shaped in cross-section.

11. An apparatus according to claim 1, characterized in that the spiral (2) is made of flats having in cross-section two parallel sides the length of which is substantially greater than the distance therebetween.

12. An apparatus according to claim 11, characterized in that the spiral has a winding in which a longitudinal axis (18) of the section of the coil is inclined to a normal (21) to the center line (13) of the spiral (2).

13. An apparatus according to claim 12 characterized in that the spiral (2) is made of flats with at least one pointed edge (24).

14. An apparatus according to claim 11, characterized in that the spiral (2) is made of flats with at least one bent edge (22, 23).

15. An apparatus according to claim 14 characterized in that the spiral (2) is made of flats with at least one pointed edge (24).

16. An apparatus according to claim 11 characterized in that the spiral (2) is made of flats with at least one pointed edge (24).

17. An apparatus according to claim 11 characterized in that the spirals (53, 54) have the windings in which a longitudinal axis (55) of the section of the body of coils of one spiral (53) is perpendicular to a longitudinal axis (56) of the section of the body of coils of the other spiral (54).

18. An apparatus according to claim 17 characterized in that the working member (1) is made up of at least two spirals (45, 46, 49, 50), the spirals being installed one inside, the other.

19. An apparatus according to claim 1, characterized in that at least one of surfaces of the coils is provided with alternating projections (27, 29) and interprojection spaces (28, 30).

20. An apparatus according to claim 1, characterized in that the spiral (2) of the working member (1) is made of a plurality of strands.

21. An apparatus according to claim 1, characterized in that side surfaces of the coils are provided with plates (31) of a wear-resistant material, made in the form of circular segments.

22. An apparatus according to claim 1, characterized in that the spiral (2) of the working member (1) is made sectional incorporating at least two sections (34, 35, 37, 38).

23. An apparatus according to claim 22, characterized in that the sections (37, 38) have different diameters of winding.

24. An apparatus according to any of claims 22, 23, characterized in that the sections (34, 35, 37, 38) are interconnected for relative rotation.

25. An apparatus according to claim 1, characterized in that an additional spiral (44) is wound on the external surface of the body of coils (43) of the spiral (2).

26. An apparatus according to claim 1, characterized in that the working (1) is made up of at least two spirals (45, 49, 50), the spirals being installed one inside the other.

27. An apparatus according to claim 26, characterized in that the spirals (49, 50) have different diameters and the ends of the spirals are set concentric with and central portions, eccentric to their center lines, and the coils of said spiral bear against one another at least in one like zone of the maximum deformation to the modulus of elasticity.

28. An apparatus according to claim 26, characterized in that the spirals are installed coaxially.

29. An apparatus according to claim 28, characterized in that the spirals have equal diameters.

30. An apparatus according to claim 29, characterized in that spirals (57, 58) have different pitch of winding.

31. An apparatus according to claim 29, characterized in that spirals (59, 60) bear against each other in the zone of the inside radius of curvature of the working member (1) in pairs by lateral surfaces of opposite sides of the adjacent coils of the spirals at one side, while at the other side there is a clearance between the lateral surfaces of the opposite sides of the coils which is greate than the clearance between the coils of the spirals (59, 60) in the zone of the outside radius of curvature of the working member (1).

32. An apparatus according to claim 29, characterized in that spirals (61, 2) have different profiles of the body of coils insuring a point contact in the cross-section.

33. An apparatus according to claim 29, characterized in that one (66) of the spirals has the body of spirals rectangular in cross-section and another (67) has the body of spirals double-T in cross-section, and the coils of the spirals are alternating, and the longitudinal axis of symmetry of the rectangular section and the axis of symmetry of the double-T section are normal to the center line (13) of the working member (1).

34. An apparatus according to claim 29, characterized in that side surfaces of the body of adjacent coils (70, 71) of the spirals are profiled at least along quadratic curves insuring a mutual rolling of said side surfaces.

35. An apparatus according to claim 29, characterized in that one (77) of the spirals is made of flats provided with openings (79) internally accommodating bodies of revolution (80).

36. An apparatus according to claim 1, characterized in that the working member (1) is provided with a means (81) for intensification of the grinding.

37. An apparatus according to claim 36, characterized in that a means for intensification of the grinding is made in the form of at least one cone-shaped roll (81) installed at the end of the working member (1) in its space and facing the latter by its vertex, the roll generatrix being snugly contiguous with the coils of the spiral (2) in the zone of the larger radius of curvature of the working member (1).

38. An apparatus according to claim 1, characterized in that an external force (Q) is applied to the working member (1) along the radius towards the center of curvature of its center line (13).

39. An apparatus according to claim 38, characterized in that an external force (Q) is developed by means of at least one roller (22) internally installed in the central portion of the working member (1) and end faces of said roller are associated with the ends of the working member (1) through the medium of elastic elements (83, 84).

40. An apparatus according to claim 38, characterized in that an external force (Q) is developed by means of a magnetic field.

41. An apparatus according to claim 1, characterized in that at least to one of the ends of the working member (1) the central angle of the arc of which is essentially in range of 1° to 135° is applied an external force (Q) directed tangent to the center line (13) of said working member.

42. An apparatus according to claim 1, characterized in that the working member is installed on a support (88) and one end (91) of said working member is secured for movement relative to the other end.

43. An apparatus according to claim 1, characterized in that one end of the working member (1) is secured on the shaft of a drive (94) and the other end is installed on an axle of the additional support (8) secured on a bracket (96) rigidly associated with a housing of the drive (94).

44. An apparatus according to claims 1, characterized in that it comprises a grinding chamber (99) made in the form of a tube encompassing the working member (1) and the axis of which coincides with the center line (13) of the working member (1).

45. An apparatus according to claim 44, characterized in that the ends of the chamber (99) are interconnected by a pipeline (104).

46. An apparatus according to claim 45, characterized in that the chamber (99) is installed on the frame (9) for turning in the plane of the center line (13) of the working member (1) about a substantially horizontal axis.

47. An apparatus according to claim 44, characterized in that a chamber (110) is made of an elastic material.

48. An apparatus according to claim 44, characterized in that the chamber (99, 110) is provided with a deflecting element fixedly secured on the internal surface thereof.

49. An apparatus according to claim 48, characterized in that the deflecting element is made in the form of a helical spiral (116).

50. An apparatus according to claim 44, characterized in that a portion (123) of the wall of a chamber (122) disposed in the zone of the outside radius of curvature of the working member is made of an elastic material and kinematically associated with a source of oscillations directed along the normal to the center line (13) of the working member (1).

51. An apparatus according to claim 44, characterized in that it comprises a centrifugal pump a housing (129) of which is installed at the outlet of a grinding chamber (127) and its impeller (128) is rigidly associated with a respective end of the working member (1).

52. An apparatus according to claim 51, characterized in that it is provided with a cone-shaped vessel (131) disposed vertically with its vertex facing down and internally accommodating a tube (132) coaxial with said vessel, the lower end of said tube being communicated with the outlet connection (112) of the centrifugal pump, while the upper end enters the vessel (131) and the lower portion of the vessel is communicated with the inlet of the grinding chamber (127).

53. An apparatus according to claim 44, characterized in that it comprises a separating chamber (138) made in the form of two cones (139) 140) associated by their bases with vertices directed oppositely along the vertical axis and provided with a connection (143) for delivery of a material to be ground and a connection (145) for removal of the ground fraction, and with a means for delivery of air in the lower cone, the inlet (141) of the grinding chamber (137) being communicated with the lower end of the separating chamber (138) and the outlet (142) of the chamber (137) being disposed in the central portion of the plane of the bases.

54. An apparatus comprising at least two working members (1) according to claim 44, characterized in that chambers (150) are communicated with each other in succession.

55. An apparatus comprising at least two working members (1) according to claim 1, characterized in that it incorporates a grinding chamber (159) made in the form of a tray internally accommodating the working members (1) separated from one another by partitions (165) passing at right angles to the axis of the chamber (159) and each of said partitions forms with an opposite wall a port (166) occupying not more than half of the cross-section of the chamber (159) and directly bears against one of the walls, the ports (166) of the adjacent partitions (165) being arranged in plan in a staggered order.

56. An apparatus comprising at least two working members (1) according to claim 1, characterized in that the working members (1) are disposed in a grinding chamber (167) provided with a cover (168*a*) having a connection (169) for removal of the ground fraction and internally accommodating partitions (171) separating the working members (1) and having a clearance in relation to the internal surface of the chamber (167), means (173) for delivery of air being arranged between the adjacent working members (1).

57. An apparatus comprising at least two working members (1) according to claim 1, characterized in that it incorporates a grinding chamber (174) made in the form of two concentrically arranged trays (175, 176) with the working member (1) disposed therebetween, at least one of the trays (175) being installed on the frame for oscillation in the direction of the axis of the chamber (174).

58. An apparatus comprising at least two working members (1) according to claim 1, characterized in that the working members (1) are disposed in a grinding chamber (180) made in the form of a tray made up of two sections connected with each other by end faces and the longitudinal axes of which form in the vertical plane an obtuse angle with its vertex facing down, a means (184) for delivery of air being installed in the zone where the sections are connected and the chamber has a cover with a connection (187) for removal of the ground fraction.

59. An apparatus comprising at least two working members (1) according to claim 1, characterized in that it incorporates a grinding chamber (188) formed by face and side walls (190, 191) wherein the working members (1) are disposed one over another, and the arcs of their center lines with the central angles being essentially in a range of 1° to 135° are equidistant and lie in one plane, partitions (192) which alternately separate the working members (1) being secured to each side wall and each of the partitions (192) having a clearance in relation to an opposite side wall.

60. An apparatus according to claim 1, characterized in that it comprises a grinding chamber (193) made in the form of a drum installed for rotation about a horizontal axis, the torque of the drive (161) being applied to the chamber (193), and the ends of the working member (1) are rigidly secured on end plates of the drum concentric with the axis of rotation, and a weight (194) is attached to the central portion of the working member (1).

61. An apparatus according to claim 1, characterized in that the working member (1) is disposed in grinding chamber (198) made in the form of a portion of the body formed by rotation of a U-shaped contour about the axis perpendicular to the axis of symmetry of the generatrix and a face wall (196) with the drive (6) installed thereon, the chamber (198) being installed for turning relative to the face wall (196) about the axis of the body of revolution, and the center of curvature of the working member (1) being located on this axis.

62. An apparatus according to claim 1, characterized in that it comprises a grinding chamber (202) of a spherical shape internally accommodating the working member (1) associated by one end with the shaft (5) of the drive (6) an axis (205) of which coincides with a vertical axis (103) of the chamber (202), the other end of the working member (1) being installed for free rotation in the support (8) disposed on a free end of a cantilever (204) installed for rotation about the axis (203) of the shaft (5) of the drive (6).

63. An apparatus according to claim 62, characterized in that the cantilever is made in the form of a tube (210) encompassing the working member (1) and provided with a port (211) arranged at the free end of the tube (210) for intake of the material.

* * * * *